US009188914B2

(12) United States Patent
Takagi et al.

(10) Patent No.: US 9,188,914 B2
(45) Date of Patent: Nov. 17, 2015

(54) IMAGE FORMING APPARATUS INCLUDING FUSING DEVICE

(71) Applicant: KYOCERA DOCUMENT SOLUTIONS INC., Osaka (JP)

(72) Inventors: Masaru Takagi, Osaka (JP); Tomohiko Yamakawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/242,920

(22) Filed: Apr. 2, 2014

(65) Prior Publication Data

US 2014/0301751 A1 Oct. 9, 2014

(30) Foreign Application Priority Data

Apr. 3, 2013 (JP) ..... 2013-077704

(51) Int. Cl.
*G03G 15/20* (2006.01)

(52) U.S. Cl.
CPC ..... *G03G 15/2032* (2013.01); *G03G 15/2064* (2013.01); *G03G 15/2003* (2013.01); *G03G 15/2067* (2013.01); *G03G 15/2078* (2013.01); *G03G 2215/20* (2013.01)

(58) Field of Classification Search
CPC ..... G03G 15/20
USPC ..... 399/67
See application file for complete search history.

(56) References Cited

U.S. PATENT DOCUMENTS

| | | | | |
|---|---|---|---|---|
| 7,751,768 | B2 | 7/2010 | Yamada | |
| 8,320,808 | B2 * | 11/2012 | Yamada | 399/323 |
| 8,515,312 | B2 * | 8/2013 | Yamada | 399/122 |
| 8,571,455 | B2 * | 10/2013 | Yamada | 399/323 |

(Continued)

FOREIGN PATENT DOCUMENTS

| | | | |
|---|---|---|---|
| JP | 2008-83515 | A | 4/2008 |
| JP | 2009-092987 | A | 4/2009 |

(Continued)

OTHER PUBLICATIONS

The extended European search report issued by the European Patent Office on Oct. 16, 2014, which corresponds to European Patent Application No. 14163039.2-1560 and is related to U.S. Appl. No. 14/242,920.

(Continued)

*Primary Examiner* — Clayton E Laballe
*Assistant Examiner* — Kevin Butler
(74) *Attorney, Agent, or Firm* — Studebaker & Brackett PC

(57) ABSTRACT

A fusing device includes a first roller, a second roller forming a fusing nip part together with the first roller, an adjustment mechanism changing posture of the first roller between first and second postures, a separation member, a turning mechanism, an abutting member, and an isolation mechanism. The turning mechanism turns the separation member so that the separation member approaches the first roller when the posture of the first roller is changed from the second posture to the first posture. The abutting member abuts on the first roller to form a gap between the separation member and the first roller when the first roller is in the first posture. The isolation mechanism separates the abutting member from the first roller in a process when posture of the first roller is changed from the first posture to the second posture.

6 Claims, 17 Drawing Sheets

(56) References Cited

U.S. PATENT DOCUMENTS

| | | | | |
|---|---|---|---|---|
| 8,737,859 | B2 * | 5/2014 | Yuasa et al. | 399/67 |
| 8,744,329 | B2 * | 6/2014 | Yamada | 399/327 |
| 8,811,838 | B2 * | 8/2014 | Yamada | 399/33 |
| 2003/0081970 | A1 * | 5/2003 | Yamamoto et al. | 399/323 |
| 2004/0146323 | A1 * | 7/2004 | Fujisawa et al. | 399/323 |
| 2008/0260435 | A1 * | 10/2008 | Chikugo et al. | 399/323 |
| 2010/0221047 | A1 * | 9/2010 | Nakajima et al. | 399/323 |
| 2010/0303521 | A1 * | 12/2010 | Ogawa et al. | 399/323 |
| 2014/0029989 | A1 * | 1/2014 | Koda et al. | 399/323 |
| 2014/0301751 | A1 * | 10/2014 | Takagi et al. | 399/67 |

FOREIGN PATENT DOCUMENTS

| | | | |
|---|---|---|---|
| JP | 2011-180202 | A | 9/2011 |
| JP | 2012-226006 | A | 11/2012 |

OTHER PUBLICATIONS

An Office Action; "Notice of Reasons for Rejection," issued by the Japanese Patent Office on Jul. 21, 2015, which corresponds to Japanese Patent Application No. 2013-077704 and is related to U.S. Appl. No. 14/242,920.

* cited by examiner

IMAGE FORMING APPARATUS INCLUDING FUSING DEVICE

INCORPORATION BY REFERENCE

The present application claims priority under 35 U.S.C. §119 to Japanese Patent Application No. 2013-077704, filed Apr. 3, 2013. The contents of this application are incorporated herein by reference in their entirety.

BACKGROUND

The present disclosure relates to a fusing device to fuse a toner image to a sheet and an image forming apparatus to which the fusing device is applied.

Fusing devices for image forming apparatuses include a fusing nip part formed in a manner that a fusing roller is in press contact with a pressure roller. Pressure and heat are applied to a sheet when the sheet passes through the fusing nip part, thereby fusing to the sheet a toner image transferred to the sheet. Incidentally, toner melted after the sheet passes through the fusing nip part may form an adhesive layer. This may cause the sheet to adhere to the peripheral surface of the fusing roller. In this case, the sheet may wind around the fusing roller. In order to prevent such winding, a separation member is provided downstream of the fusing nip part in the rotation direction of the fusing roller. The separation member is arranged close to the fusing roller to separate the sheet, which starts winding to the fusing roller, from the fusing roller.

The separation member includes a plate-shaped member extending in the axial direction of the fusing roller. Where the tip end of the plate-shaped member is always in contact with the peripheral surface of the fusing roller, the peripheral surface of the fusing roller may be scared. If a toner image is fused to a sheet with the use of the fusing roller of which peripheral surface is scared, the scar may appear on the toner image. This scar may cause an image defect. For this reason, a gap is left between the tip end of the plate-shaped member and the peripheral surface of the fusing roller. This gap is formed with the use of an abutting member mounted on the end of the separation member. The known abutting member is always in contact with the peripheral surface of the fusing roller in a non-sheet passing region of the fusing roller.

SUMMARY

A fusing device according to the first mode of the present disclosure includes a first roller, a second roller, an adjustment mechanism, a separation member, a turning mechanism, an abutting member, and an isolation mechanism. The first roller rotates about its axis. The second roller rotates about is axis. The second roller forms a fusing nip part together with the first roller. The adjustment mechanism changes posture of the first roller or the second roller between first posture and second posture to adjust a nip pressure of the fusing nip part. The adjustment mechanism sets the first or second roller in the first posture to allow the first or second roller to be in press contact with the second or first roller by a first pressure. The adjustment mechanism sets the first or second roller in the second posture to allow the first or second roller to be in press contact with the second or first roller by a second pressure which is reduced from the first pressure. The separation member is arranged downstream of the fusing nip part in a direction of rotation of the first roller. The separation member includes a plate-shaped member extending in an axial direction of the first roller. The turning mechanism turns the separation member about an axis parallel to the axial direction of the first roller. The turning mechanism turns the separation member so that a tip end of the plate-shaped member approaches a peripheral surface of the first roller when the posture of the first or second roller is changed from the second posture to the first posture. The abutting member is mounted on each opposite end of the plate-shaped member of the separation member. The abutting member abuts, when the first or second roller is in the first posture, on the peripheral surface of the first roller in a vicinity of each opposite end of the first roller to form a gap between the tip end of the plate-shaped member and the peripheral surface of the first roller. The isolation mechanism allows the abutting member to abut on the peripheral surface of the first roller when the first or second roller is in the first posture and separates the abutting member from the peripheral surface of the first roller in the process when the posture of the first or second roller is changed from the first posture to the second posture.

A fusing device according to the second mode of the present disclosure further includes a heater of induction heating type in the fusing device according to the first mode. The heater heats the first roller. The first roller and the second roller rotate when the first or second roller is in the first posture. Further, the first and second rollers rotate when the first or second roller is in the second posture.

An image forming apparatus according to the third mode of the present disclosure includes an image forming section and a fusing device according to the first mode. The image forming section transfers a toner image to a sheet. The fusing device fuses the toner image to the sheet.

An image forming apparatus according to the fourth mode of the present disclosure includes an image forming section, a fusing device according to the second mode, a drive section, a mode switching section, and a controller. The image forming section transfers a toner image to a sheet. The fusing device fuses the toner image to the sheet. The drive section drives the first or second roller. The mode switching section switches an operating mode of the image forming apparatus between a first mode and a second mode, the first mode being a mode in which image formation is performed on a sheet to cause the sheet to pass through the fusing nip part, and the second mode being a standby state for image formation to cause no sheet to pass through the fusing nip part. The controller controls the adjustment mechanism so that the first or second roller is in the first posture in the first mode and so that the first or second roller is in the second posture in the second mode. Further, the controller controls the drive section so that the first and second rollers rotate in the first mode. Furthermore, the controller controls the drive section so that the first and second rollers rotate in the second mode.

DETAILED DESCRIPTION

Figure 1:
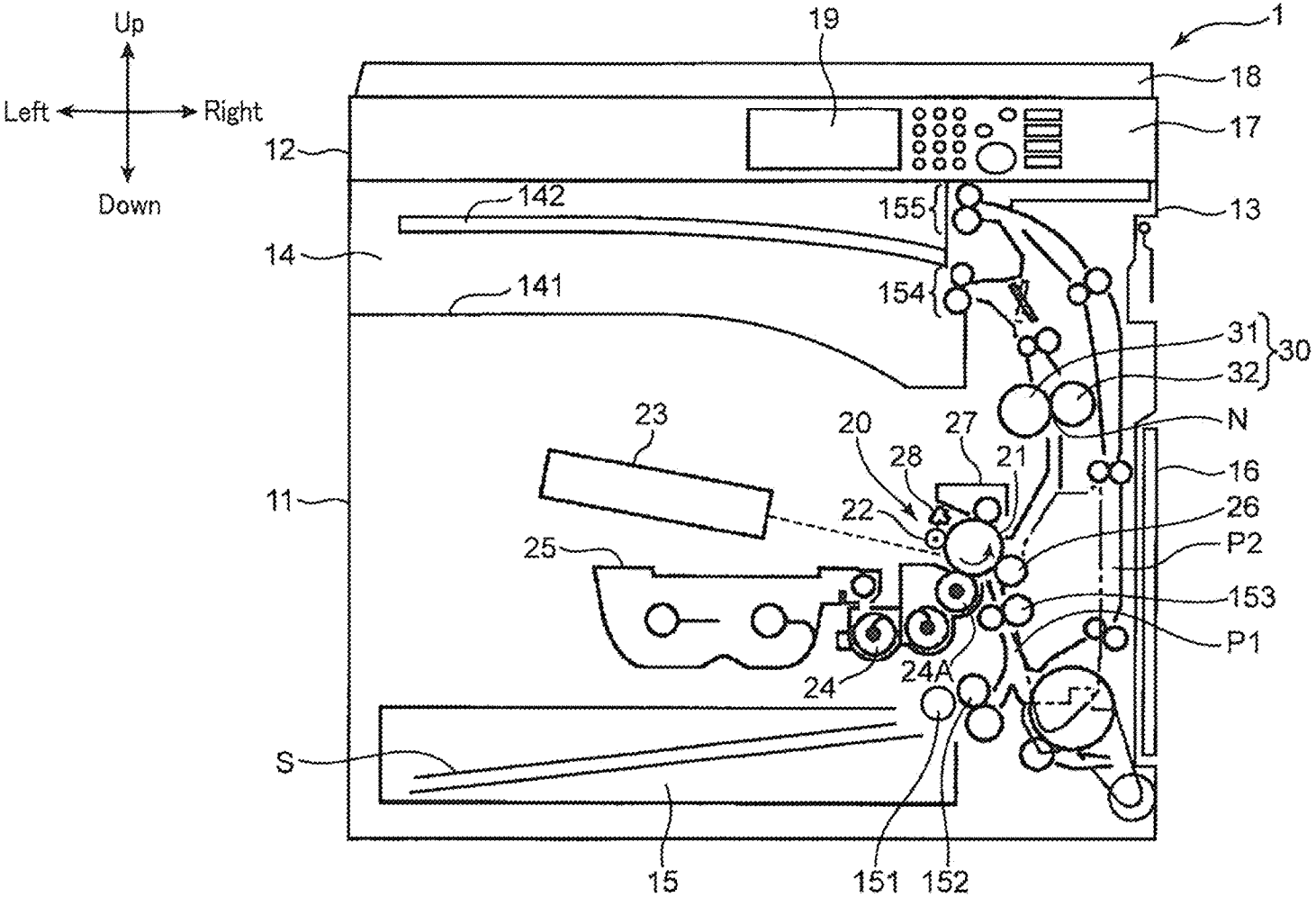
FIG. 1 is a schematic cross sectional view showing an overall configuration of an image forming apparatus according to one embodiment of the present disclosure. Z

Embodiments of the present disclosure will be described below with reference to the accompanying drawings. FIG. 1 is a cross sectional view showing an internal configuration of an image forming apparatus 1 according to one embodiment of the present disclosure. The image forming apparatus 1 in the present embodiment is a monochrome printer having a copying function. It is noted that the image forming apparatus according to the present disclosure is not limited to the monochrome printer having a copying function.

The image forming apparatus 1 includes a main body as a housing substantially in a rectangular parallelepiped shape. The main body is a casing to accommodate various devices for performing image formation on a sheet. The main body includes a body housing 11 substantially in a rectangular parallelepiped shape, a scanner housing 12 substantially in a rectangular parallelepipedal shape, and a joint housing 13. The scanner housing 12 is arranged above the body housing 11. The joint housing 13 joins the body housing 11 and the scanner housing 12 together.

An image forming section 20 for transfer of a toner image to a sheet is accommodated in the body housing 11. A fusing device 30 to fuse a toner image to a sheet is accommodated in the joint housing 13. A scanner unit 17 is accommodated in the scanner housing 12. The scanner unit 17 optically reads an image on a document sheet to generate image data. The main body includes an in-body discharge section 14. The in-body discharge section 14 is an in-body space surrounded by the upper surface of body housing 11, the lower surface of the scanner housing 12, and the left surface of the joint housing 13. A sheet subjected to image formation is ejected to the in-body discharge section 14.

The joint housing 13 is arranged on the right side surface of the main body 10. In the joint housing 13, a first sheet exit port 154 and a second sheet exit port 155 arranged above the first sheet exit port 154 are formed. The first sheet exit port 154 opens toward the in-body space for ejection of a sheet toward the in-body discharge section 14. The second sheet exit port 155 also opens toward the in-body space similarly to the first sheet exit port 154. The bottom of the in-body space is defined by an in-body discharge tray 141. The in-body discharge tray 141 is located below the first sheet exit port 154 and forms the upper surface of the body housing 11. The in-body discharge tray 141 receives a sheet ejected from the first sheet exit port 154. A sub exit tray 142 is provided above the in-body discharge tray 141. The sub exit tray 142 is fitted between the first sheet exit port 154 and the second sheet exit port 155. The sub exit tray 142 receives a sheet ejected from the second sheet exit port 155. Further, a sheet to be subjected to duplex printing is temporarily ejected to the sub exit tray 142 for switchback conveyance.

A sheet feed cassette 15 is detachably fitted in the lower part of the main body. The sheet feed cassette 15 accommodates a sheet to be subjected to image formation. Further, a manual feed tray 16 is provided on the right side surface of the main body. The manual feed tray 16 is used for manual sheet feed.

The image forming section 20 includes a photosensitive drum 21. The image forming section 20 further includes an electrostatic charger 22, an exposure device 23, a developing device 24, a transfer roller 26, a cleaner 27, and a static eliminator 28, which are arranged around the photosensitive drum 21. The photosensitive drum 21 rotates about its axis. Further, the photosensitive drum 21 has a peripheral surface on which an electrostatic latent image and a toner image are to be formed. The electrostatic charger 22 uniformly charges the peripheral surface of the photosensitive drum 21. The exposure device 23 irradiates laser light to the peripheral surface of the photosensitive drum 21 to form an electrostatic latent image. The developing device 24 includes a development roller 24A. The development roller 24A supplies toner to the peripheral surface of the photosensitive drum 21 to develop an electrostatic latent image formed on the peripheral surface of the photosensitive drum 21. The developing device 24 is replenished with toner supplied from a toner container 25. The transfer roller 26 forms a transfer nip part together with the photosensitive drum 21, thereby transferring a toner image to a sheet from the photosensitive drum 21. The cleaner 27 cleans the peripheral surface of the photosensitive drum 21 after transfer of a toner image. The static eliminator 28 irradiates static eliminating light to the peripheral surface of the photosensitive drum 21 after transfer of a toner image to eliminate static electricity on the peripheral surface of the photosensitive drum 21.

The fusing device 30 includes a fusing roller 31 (first roller) in which a heat source is provided and a pressure roller 32 (second roller). The pressure roller 32 forms a fusing nip part N together with the fusing roller 31. The fusing device 30 performs fusing to melt toner to a sheet. Specifically, in the fusing nip part N, the fusing device 30 applies heat and pressure to a sheet to which a toner image is transferred in the transfer nip part. Thus, the toner image is fused to the sheet. A sheet subjected to fusing is ejected from the first sheet exit port 154 or the second sheet exit port 155 to the in-body discharge section 14. The fusing device 30 will be described later in detail.

The scanner unit 17 in the scanner housing 12 includes a carriage (not shown) on which an image sensor, a light source, a mirror, etc. (each not shown) are boarded. The light source irradiates light to a document sheet. The mirror guides the reflected light from a document sheet to the image sensor. A contact glass, on which a document sheet is to be loaded, is fitted on the upper surface of the scanner unit 17. Further, the main body includes a document cover 18 capable of covering the upper surface of the scanner unit 17. The document cover 18 can press a document sheet loaded on the contact glass.

An operating panel 19 is mounted on the front surface of the scanner housing 12. The operating panel 19 includes a LCD touch panel, a numeric keypad, etc. to receive input from the user. Through the operating panel 19, various operating information to the image forming apparatus 1 is input.

A sheet conveyance path for conveyance of a sheet is formed in the interior of the main body. The sheet conveyance path includes a main conveyance path P1 vertically extending from a part around the lower part to a part around the upper part of the main body. The main conveyance path P1 goes through the image forming section 20 and the fusing device 30. The downstream end of the main conveyance path P1 is connected to the first and second sheet exit ports 154 and 155. Further, a reversed sheet conveyance path P2 extends from the most downstream end to a part around the upstream end of the main conveyance path P1. The reversed sheet conveyance path P2 conveys a sheet from the most downstream end to the part around the upstream end of the main conveyance path P1 in duplex printing.

The sheet feed cassette 15 includes a sheet accommodating section to accommodate a sheaf of sheets S. A pickup roller 151 and a sheet feed roller pair 152 are provided around the upper right part of the sheet feed cassette 15. The pickup roller 151 picks up the uppermost sheet S of the sheet sheaf on a sheet-by-sheet basis. The sheet feed roller pair 152 sends out the picked sheet to the upstream end of the main conveyance path P1. A sheet loaded on the manual feed tray 16 is also sent out to the upstream end of the main conveyance path P1. A registration roller pair 153 is arranged upstream of the image forming section 20 in the main conveyance path P1. The registration roller pair 153 sends out a sheet to the transfer nip part with preset timing.

In order to perform simplex printing (image formation) on a sheet S, the sheet S is sent out from the sheet feed cassette 15 or the manual feed tray 16 to the main conveyance path P1, and a toner image is transferred to the sheet S in the image forming section 20. Thereafter, the transferred toner is fused to the sheet S in the fusing device 30. Then, the sheet S is ejected from the first sheet exit port 154 onto the in-body exit tray 141. By contrast, in order to perform duplex printing on a sheet S, after transfer and fusing are performed on one surface of the sheet S, a part of the sheet S is ejected onto the sub exit tray 142 from the second sheet exit port 155. Then, the sheet S is subjected to switchback conveyance to be returned to the part around the upstream end of the main conveyance path P1 via the reverse sheet conveyance path P2. Thereafter, the other surface of the sheet S is subjected to transfer and fusing. Then, the sheet S is ejected from the first sheet exit port 154 onto the in-body exit tray 141.

Figure 2:
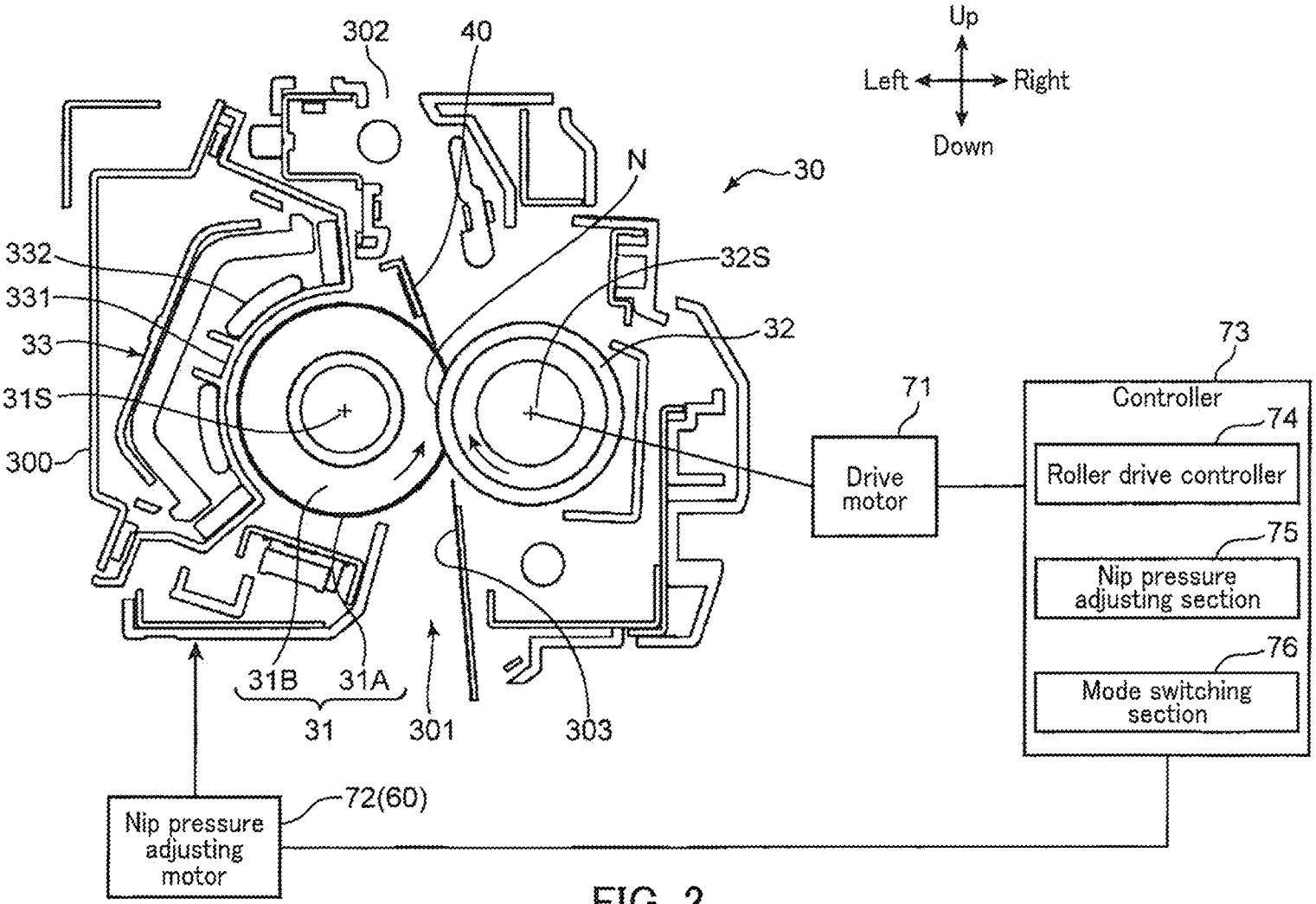
FIG. 2 is an illustration showing a schematic cross section of a fusing device according to one embodiment of the present disclosure.

The configuration of the fusing device 30 will be described in detail below. FIG. 2 is a schematic cross sectional view of the fusing device 30. FIG. 2 also shows a control blocks for the fusing device 30. The fusing device 30 includes the fixing roller 31 and the pressure roller 32. The fusing device 30 further includes a heater 33 of induction heating type and a fuser housing 300. The heater 33 heats the fusing roller 31. The fuser housing 300 accommodates the fusing roller 31, the pressure roller 32, the heater 33, etc. An inlet 301 to receive a sheet (not shown) from the image forming section 20 is formed in the fuser housing 300. Further, an outlet 302 to send out a sheet subjected to fusing is formed in the fuser housing 300. A guide plate 303 to guide a sheet toward the fusing nip part N is provided at the inlet 301.

The fusing roller 31 has a rotational axis 31S (first rotational axis) extending back and forth (perpendicularly to the sheet of FIG. 2). The pressure roller 32 has a rotational axis 32S (second rotational axis) extending back and forth in parallel to the rotational axis 31S. The fusing roller 31 and the pressure roller 32 are held in the fuser housing 300 (movable framework 37 and fixed framework 36) so as to be respectively rotatable about the rotational axes 31S and 32S. In the present embodiment, rotational drive force to rotate the pressure roller 32 in the clockwise direction is applied to the pressure roller 32. Accompanied by rotation of the pressure roller 32, the fusing roller 31 follows and rotates in the anti-clockwise direction.

The fusing roller 31 includes a fusing belt 31A and an elastic roller member 31B. The fusing belt 31A is fitted around the roller member 31B with clearance left. One example of the roller member 31B may be a roller having a configuration in which an elastic layer is formed around a metal cored bar serving as a core. The metal cored bar may be made from SUS, or the like. The material for the elastic layer may be a silicon sponge, or the like. One example of the fusing belt 31A may be an endless belt having a multilayered structure including a magnetic metal base material, an elastic layer, and a mold release layer. The magnetic metal base material is capable of being induction heated. Nickel or the like may be used as a material for the magnetic metal base material. The material for the elastic layer may be silicon rubber or the like. The material for the mold release layer may be fluorine based resin or the like. The pressure roller 32 has a rigidity higher than the fusing roller 31. One example of the pressure roller 32 may be a roller including a non-magnetic metal cored bar serving as a core, an elastic layer, and a mold release layer. Aluminum or the like may be used as a material for the non-magnetic metal cored bar. The elastic layer is formed around the non-magnetic metal cored bar. The material for the elastic layer may be silicon rubber or the like. The mold release layer may be formed as an outermost layer of the pressure roller 32.

The fusing roller 31 is in press contact with the pressure roller 32. This deforms a part of the peripheral surface of the fusing roller 31 (fusing belt 31A), which is in contact with the pressure roller 32, into a concave arc shape. This contact part serves as the fusing nip part N. A sheet to be subjected to fusing enters the fuser housing 300 from the inlet 301 and is nipped in the fusing nip part N. The nipped sheet is conveyed by rotation of the fusing roller 31 and the pressure roller 32 about the respective rotational axes 315 and 32S. The sheet is heated and pressed when passing through the fusing nip part N. Thereafter, the sheet is conveyed out from the outlet 302. A separation member 40 is provided downstream of the fusing nip part N in the rotation direction of the fusing roller 31.

The separation member 40 is a member to prevent a sheet having passed through the fusing nip part N from winding around the peripheral surface of the fusing roller 31.

The heater 33 includes a bobbin 331 and a coil 332. The bobbin 331 has a curved shape along the outer peripheral surface of the fusing roller 31 and is arranged to face the fusing roller 31. The coil 332 is wound around the bobbin 331. High-frequency voltage for induction heating is applied to the coil 332. When the high-frequency voltage is applied to the coil 332, a magnetic path that passes through the fusing belt 31A is formed. Accordingly, an eddy current flows in the magnetic metal base material of the fusing belt 31A to heat the fusing belt 31A.

For the fusing device 30, a drive motor 71 (drive section), a nip pressure adjusting motor 72 (part of adjustment mechanism), and a controller 73 are provided additionally. The drive motor 71 generates rotational drive power to rotate the pressure roller 32 and the fusing roller 31. The nip pressure adjusting motor 72 generates drive power to move the fusing roller 31 toward the pressure roller 32 with the rotational axes 31S and 32S kept in parallel to each other. The nip pressure adjusting motor 72 adjusts the nip pressure of the fusing nip part N.

When image formation is actually performed on a sheet (image formation mode), that is, when a sheet passes through the fusing nip part N, the fusing roller 31 or the pressure roller 32 takes a pressure applying posture (first posture). When the fusing roller 31 or the pressure roller 32 is in the pressure applying posture, the fusing roller 31 is in press contact with the pressure roller 32 by a first pressure, thereby forming the fusing nip part N with a predetermined nip width. By contrast, when the image forming apparatus 1 is under preparation for image formation (sleep mode), the fusing roller 31 or the pressure roller 32 takes a pressure reducing posture (second posture). When the operating panel 19 receives an instruction for image formation in the sleep mode of the image forming apparatus 1, the operating mode of the image forming apparatus 1 is switched to the image forming mode to immediately set the image forming apparatus 1 to be in a state capable of performing image formation. In other words, when the operating mode of the image forming apparatus 1 is set in the sleep mode, the image forming apparatus 1 is in a standby state, and no sheet passes through the fusing nip part N. When the fusing roller 31 or the pressure roller 32 takes the pressure reducing posture, the fusing roller 31 is in press contact with the pressure roller 32 by a second pressure which is reduced from the first pressure. In the present embodiment, it is the posture of the fusing roller 31 that is changed between the pressure applying posture and the pressure reducing posture.

The nip pressure adjusting motor 72 generates drive power necessary for posture change between the pressure applying posture and the pressure reducing posture. It is noted that even when the fusing roller 31 is in the pressure reducing posture, the fusing nip part N is still formed as will be described later, so that the fusing roller 31 can follow rotation of the pressure roller 32 to be rotated.

The controller 73 is a microcomputer to control the operation of the fusing device 30. The controller 73 reads out a program to operate so as to have functions of a roller drive controller 74, a nip pressure adjusting section 75 (part of the adjustment mechanism), and a mode switching section 76. The roller drive controller 74 controls the operation of the drive motor 71 to control each rotation of the fusing roller 31 and the pressure roller 32. The nip pressure adjusting section 75 controls the operation of the nip pressure adjusting motor 72 to control posture change between the pressure applying posture and the pressure reducing posture. The mode switching section 76 performs control to switch the operating mode of the image forming apparatus 1 at least between the image forming mode (first mode) and the sleep mode (second mode).

When the mode switching section 76 switches the operating mode of the image forming apparatus 1 from the sleep mode to the image forming mode, the nip pressure adjusting section 75 drives the nip adjusting motor 72 to cause the fusing roller 31 to take the pressure applying posture. When the mode switching section 76 switches the operating mode of the image forming apparatus 1 from the image forming mode to the sleep mode, the nip pressure adjusting section 75 drives the nip adjusting motor 72 to cause the fusing roller 31 to take the pressure reducing posture.

When the mode switching section 76 sets the image forming mode, the roller drive controller 74 drives the drive motor 71 to rotate the fusing roller 31 and the pressure roller 32 at a first linear velocity. By contrast, when the mode switching section 76 sets the sleep mode, the roller drive controller 74 drives the drive motor 71 to rotate the fusing roller 31 and the pressure roller 32 at a second linear velocity lower than the first linear velocity.

Control by the roller drive controller 74 is performed to maintain a uniformly heated state of the fusing belt 31A. If the fusing roller 31 stops in the sleep mode, only a part of the fusing belt 31A, which faces the bobbin 331, may be heated by the heater 33 of induction heating type. Where the image forming mode is set in this state, it may take time to stably distribute the heat in the circumferential direction of the fusing belt 31A. By contrast, rotation of the fusing roller 31 even in the sleep mode can achieve uniform heating of the fusing belt 31A. Accordingly, when the mode switching section 76 switches the operating mode of the image forming apparatus 1 from the sleep mode to the image forming mode, a sheet can be allowed to immediately pass through the fusing nip part N.

Figure 3:
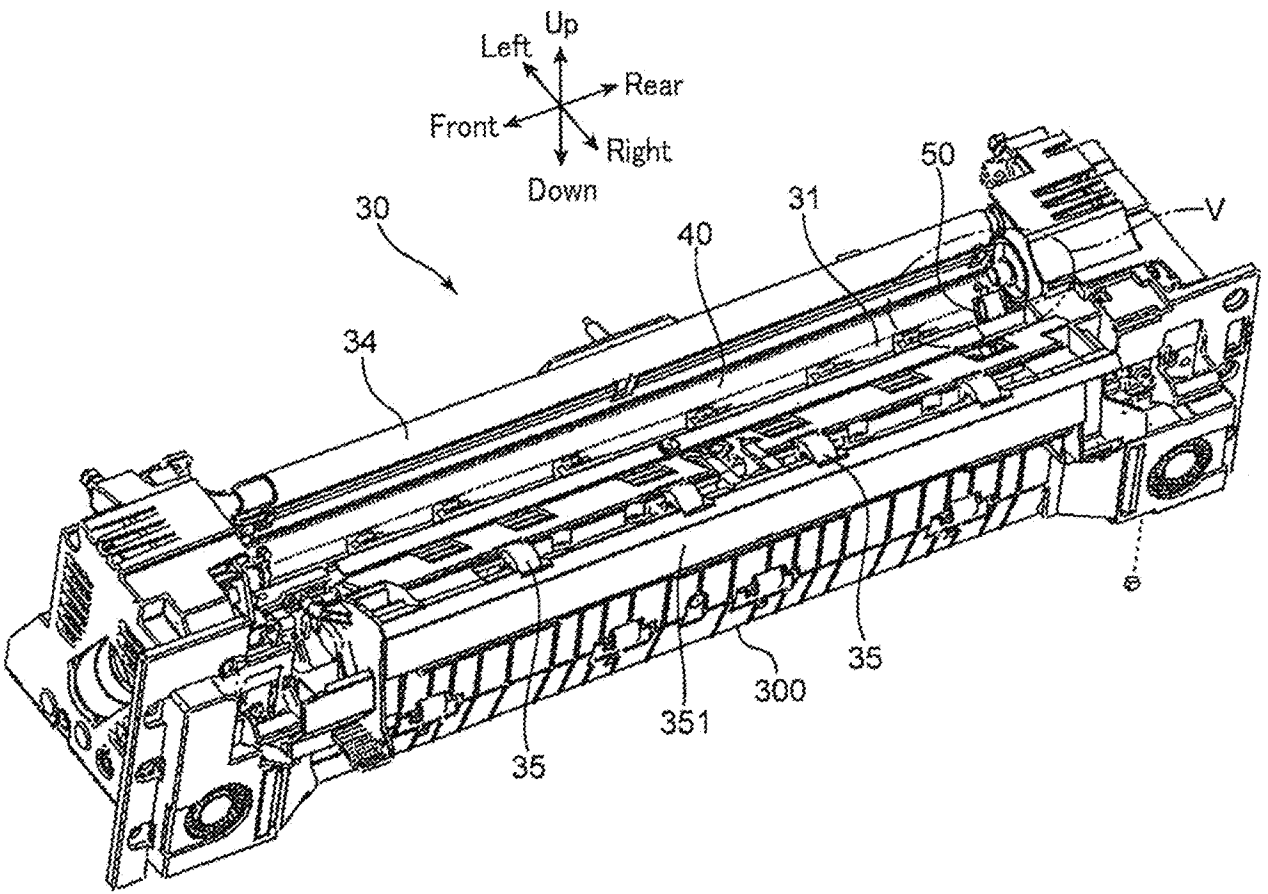
FIG. 3 is a perspective view of the fusing device according to one embodiment of the present disclosure.
Figure 4:
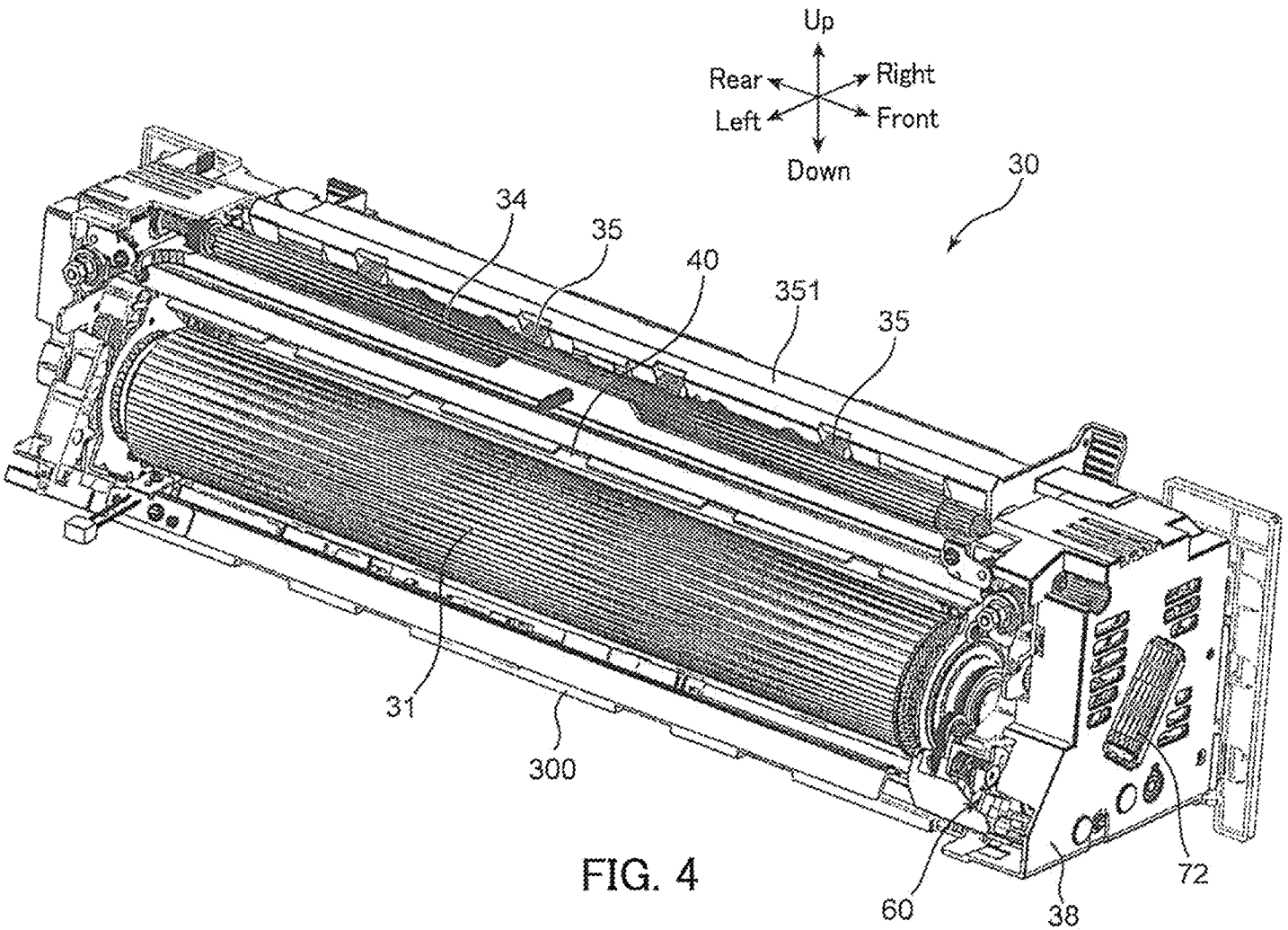
FIG. 4 is a perspective view of the fusing device according to one embodiment of the present disclosure when viewed in another direction.
Figure 5:
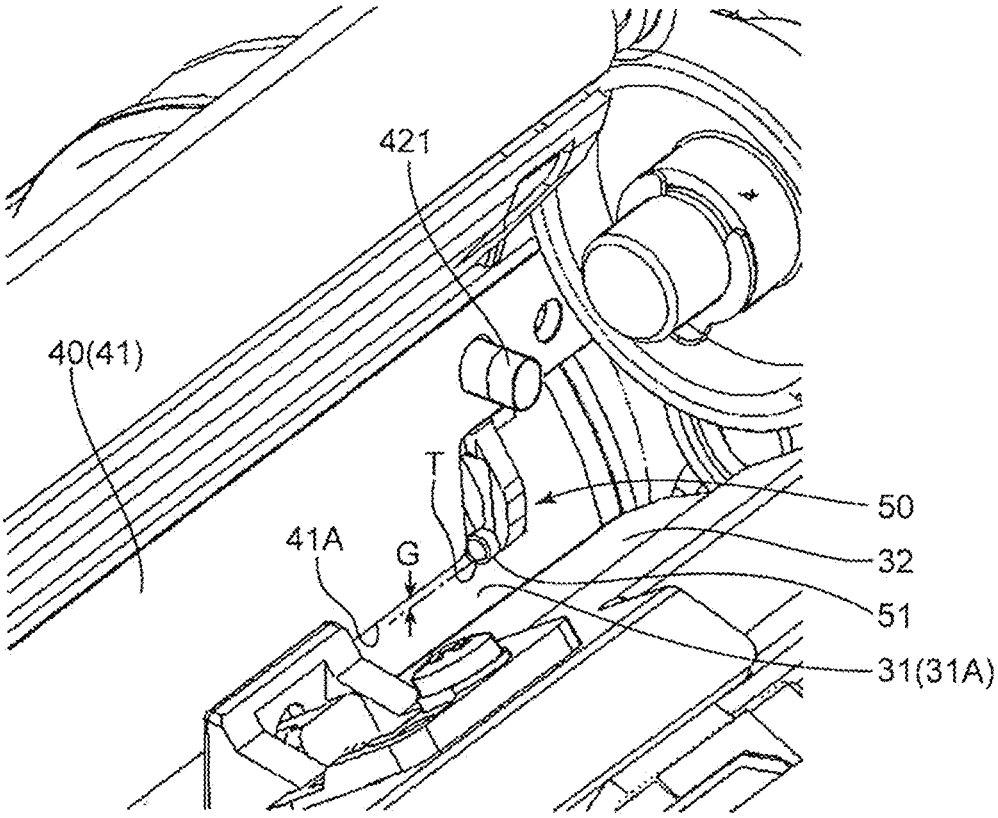
FIG. 5 is an enlarged perspective view of a part V in FIG. 3.

The hardware configuration of the fusing device 30 will be described next. FIG. 3 is a perspective view of the fusing device 30. FIG. 4 is a perspective view of the fusing device 30 when viewed in a viewing direction different from that in FIG. 3. FIG. 5 is an enlarged perspective view of a part V in FIG. 3. The fusing device 30 further includes a first conveyance roller 34 arranged in the vicinity of the outlet 302 and a second conveyance roller that forms a conveyance nip part together with the first conveyance roller 34. The first conveyance roller 34 is rotatably held at the fuser housing 300. The fuser housing 300 has a square pole shape long in the back-and-forth directions. An openable cover member 351 is mounted on the top of the fuser housing 300. FIG. 3 shows the state in which the cover member 351 opens the fuser housing 300. The second conveyance roller 35 is held by the cover member 351. As shown in FIG. 4, when the cover member 351 is closed, the second conveyance roller 35 is in contact with the first conveyance roller 34.

The separation member 40 is a thin plate-shaped member substantially in a rectangular shape extending in the axial direction of the fusing roller 31. In the vicinity of each opposite end of the fusing roller 31, the separation member 40 is supported rotatably about its axis parallel to the rotational axis 31S of the fusing roller 31 by the fuser housing 300. As shown in FIG. 5, a tip end 41A (tip end of plate-shaped member) of the separation member 40 (body portion 41) faces the peripheral surface of the fusing roller 31 (fusing belt 31A) so that a gap G is formed between the tip end 41A and the peripheral surface of the fusing roller 31.

When a sheet (not shown) having passed through the fusing nip part N reaches the gap G with it winding to the fusing roller 31, the lead edge of the sheet abuts on the tip end 41A of the separation member 40. This separates the sheet from the fusing roller 31. It is noted that a margin where no toner image is transferred is present in the lead edge part of a sheet in general. Accordingly, no toner layer acting as an adhesive layer is present on the lead edge part of a sheet. Therefore, the lead edge part of the sheet will not adhere to the fusing roller 31. Thus, even if a sheet winds around the fusing roller 31, the lead edge of the sheet floats up from the peripheral surface of the fusing roller 31, so that the sheet can be separated from the fusing roller 31 even if the tip end 41A of the separation member 40 (body portion 41) does not abut on the peripheral surface of the fusing roller 31.

Paired abutting members 50 are mounted on the respective opposite end parts of the separation member 40 (opposite end positions of the body portion 41, which will be described later). The paired abutting members 50 form the gap G between the tip end 41A of the separation member 40 (body portion 41) and the peripheral surface of the fusing roller 31. The abutting members 51 each include an abutting portion 51. The abutting portion 51 protrudes more downward than the tip end 41A of the separation member 40 and toward the center of the separation member 40. The abutting portions 51 abut on the peripheral surface of the fusing roller 31 in the vicinity of the respective opposite ends of the fusing roller 31 to form the gap G. In FIG. 5, reference character T denotes an abutting point where the shown abutting portion 51 abuts on the peripheral surface of the fusing roller 31.

Figure 6:
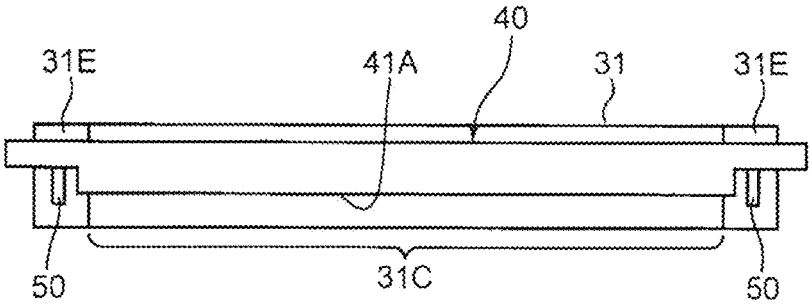
FIG. 6 is a schematic view showing the positional relationship between an abutting member and a fusing roller according to one embodiment of the present disclosure.

FIG. 6 is a schematic illustration showing the positional relationship between the abutting members 50 and the fusing roller 31. A sheet passing region 31C where a sheet (not shown) passes is set in the peripheral surface of the fusing roller 31. Sheet non-passing regions where a sheet does not pass are set outside the opposite end parts of the sheet passing region 31C. In other words, a sheet passing through the fusing nip part N will not come in contact with the peripheral surface of the fusing roller 31 in the sheet non-passing regions 31E. The abutting members 50 abut on the sheet non-passing region 31E in the peripheral surface of the fusing roller 31 to form the gap G between the tip end 41A of the separation member 40 and the peripheral surface of the fusing roller 31.

Figure 7:
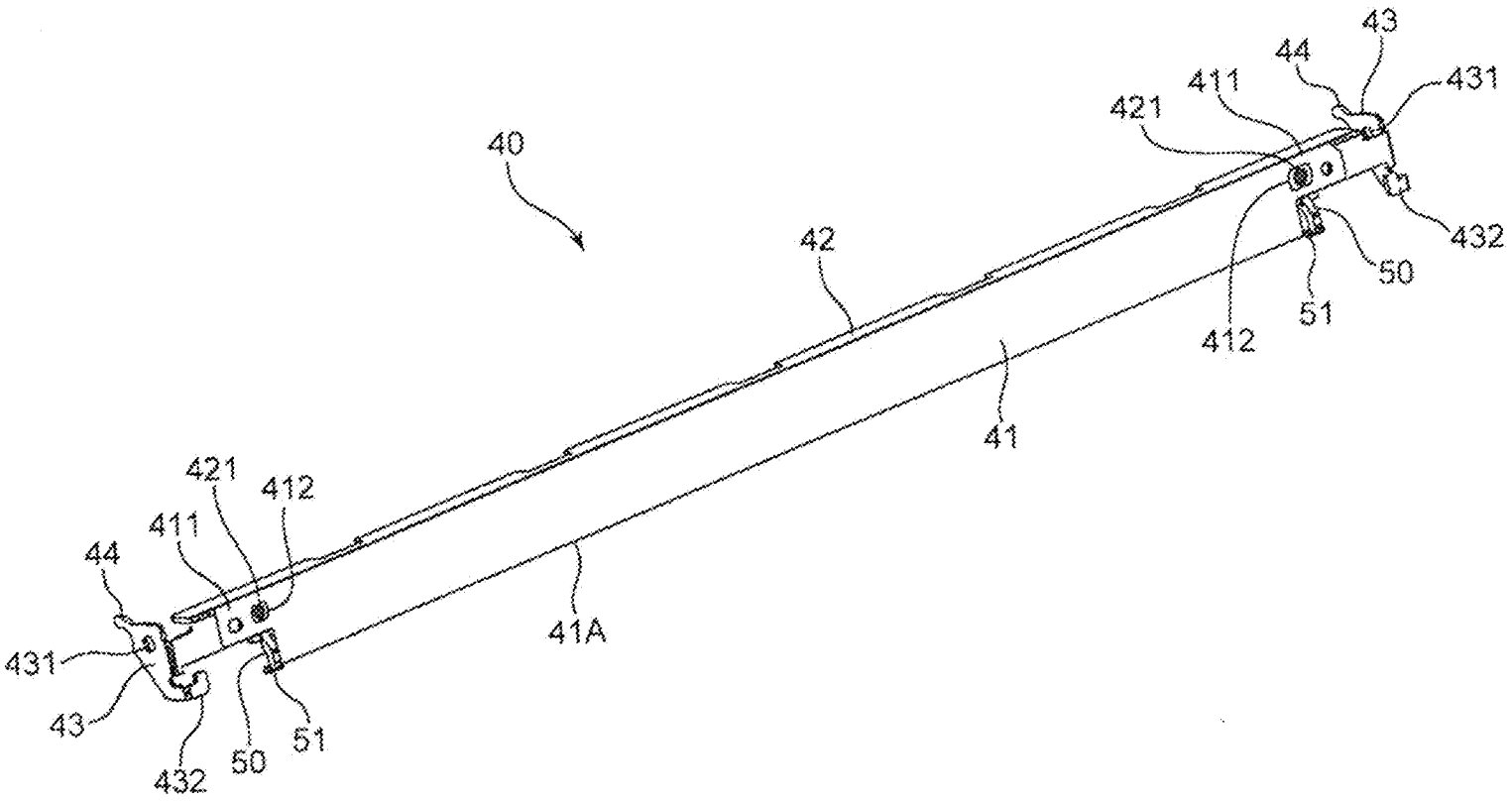
FIG. 7 is a perspective view of the obverse side of a separation member according to one embodiment of the present disclosure.
Figure 8:
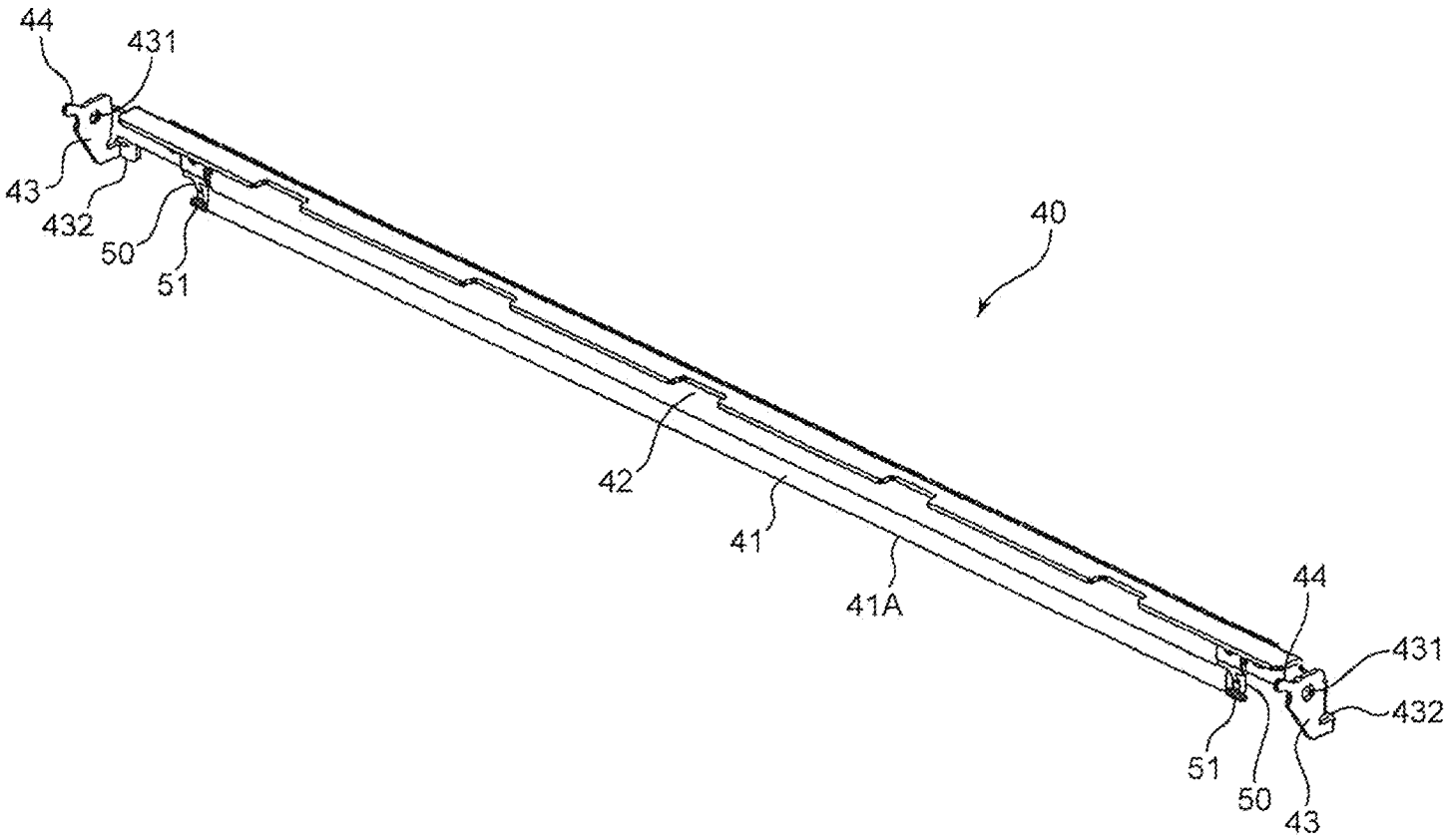
FIG. 8 is a perspective view of the reverse side of the separation member according to one embodiment of the present disclosure.

FIG. 7 is a perspective view of the obverse side of the separation member 40. FIG. 8 is a perspective view of the reverse side (side facing the peripheral surface of the fusing roller 31) of the separation member 40. The separation member 40 includes a thin plate-shaped body portion 41 (plate-shaped member) extending in the axial direction of the fusing roller 31. The separation member 40 further includes a holding plate 42 to hold the body portion 41. The lower edge of the body portion 41 serves as the tip end 41A. The holding plate 42 has a flat holding surface extending in the axial direction of the fusing roller 31. The body portion 41 is held in a state adhering to the flat holding surface, and the tip end 41A extends downward of the lower end of the holding plate 42.

An end plate 43 is provided at each opposite end of the holding plate 42. The end plate 43 will be discussed with reference to FIG. 16, which is an enlarged view of one end plate 43, in addition to FIGS. 7 and 8.

The end plates 43 each are an end portion of the holding plate 42 which is bent orthogonally to the flat holding surface. The end plates 43 are supported by side plate frame members 361 of the fixed framework 36. Each side plate frame member 361 forms a part of the fuser housing 300. A support hole 431 (part of turning mechanism) is formed in each end plate 43. Each support hole 431 is formed on the based end side (opposite side to the tip end 41A) of the separation member 40.

Support pins 363 (support portions or parts of turning mechanism) protruding from the side plate frame members 361 are inserted in the support holes 431. The separation member 40 is supported by means of the support pins 363 so as to be rotatable about an axis in parallel to the axial direction of the fusing roller 31. A torsion coil spring 45 (part of turning mechanism) is arranged in the vicinity of each support pin 363. One end 451 of each torsion coil spring 45 engages with a window 365 perforated in the corresponding side plate frame member 361. The other end 452 of the torsion coil spring 45 engages with a hook 432 of the corresponding end plate 43. It is noted that FIG. 16 shows the state before the other end 452 engages with the hook 432.

Figure 16:
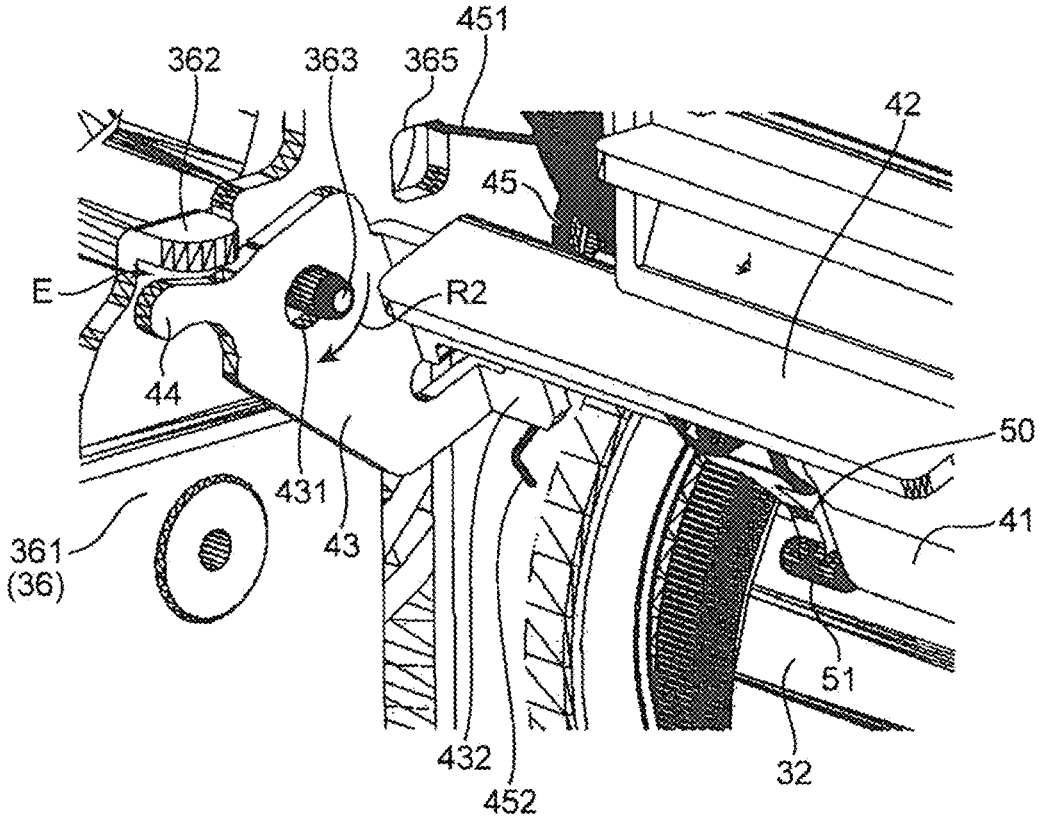
FIG. 16 is a perspective view of a main part in FIG. 14.

Each torsion coil spring 45 urges to rotate the separation member 40 about the axes of the support pins 363 in the direction where the tip end 41A approaches the peripheral surface of the fusing roller 31 (direction indicated by the arrow R2 in FIG. 16). This sets the tip end 41A to be close to the peripheral surface of the fusing roller 31 when the fusing roller 31 is in the pressure applying posture. It is noted that the support hole 431 is an oblong hole. Even if the parallel positional relationship between the tip end 41A of the separation member 40 and the peripheral surface of the fusing roller 31 deviates, the oblong support holes 431 can allow the position of the separation member 40 supported by the support pins 363 to be shifted to correct the deviation.

Protruding pieces 44 (parts of separation member which abut on stopper members) protrude from the upper parts of the respective end plates 43. The protruding pieces 44 face stoppers 362 (isolation mechanism) provided on the respective side plate frame members 361 in a state in which the support pins 363 are inserted in the support holes 431. The stoppers 362 are bent portions of the side plate frame members 361. When the separation member 40 turns in the direction indicated by the arrow R2, the protruding pieces abut on the stoppers 362. This can inhibit the separation member 40 from turning in the direction indicated by the arrow R2.

The abutting members 50 are mounted on the end parts 411 of the body portion 41 of the separation member 40. The body portion 41 is wider than the holding plate 42, while each end part 411 of the body portion 41 is substantially the same in width as the holding plate 42. The butting members 50 are mounted on the holding plate 42 to extend toward the tip end 41A from the end parts 411.

The abutting members 50 will be described below with reference to FIG. 11 as an enlarged cross sectional view of the separation member 40 in addition to FIGS. 7 and 8.

Each abutting member 50 includes the abutting portion 51. The abutting member 50 further includes a trunk portion 52 in which a screw hole is formed and a positioning pin 53 protruding from one side of the trunk portion 52. The abutting portion 51 is a tip end portion of a suspending piece 54 extending downward from the trunk portion 52. A receiving hole (not shown) in which the positioning pin 53 is fitted is formed in the holding plate 42. A screw hole (not shown) corresponding to the screw hole of the trunk 52 is also formed in the holding plate 42. In addition, a mounting hole 412 is formed in a part of each end part 411 of the body portion 41 which corresponds to the screw hole of the trunk portion 52 and the screw hole of the holding plate 42. When the positioning pins 53 are inserted in the receiving holes of the holding plate 42, the holding plate 42 provisionally catches the abutting members 50. At the provisional catch, the screw holes of the trunk portions 52 are positioned at the screw holes of the holding plate 42. Then, the mounting screws 421 pass through the screw holes of the trunk portions 52, the screw holes of the holding plate 42, and the mounting holes 412, thereby being inserted. Next, nuts (not shown) are screw inserted in the mounting screws 421, thereby fixing the main body 41 and the abutting members 50 to the holding plate 42.

Figure 9:
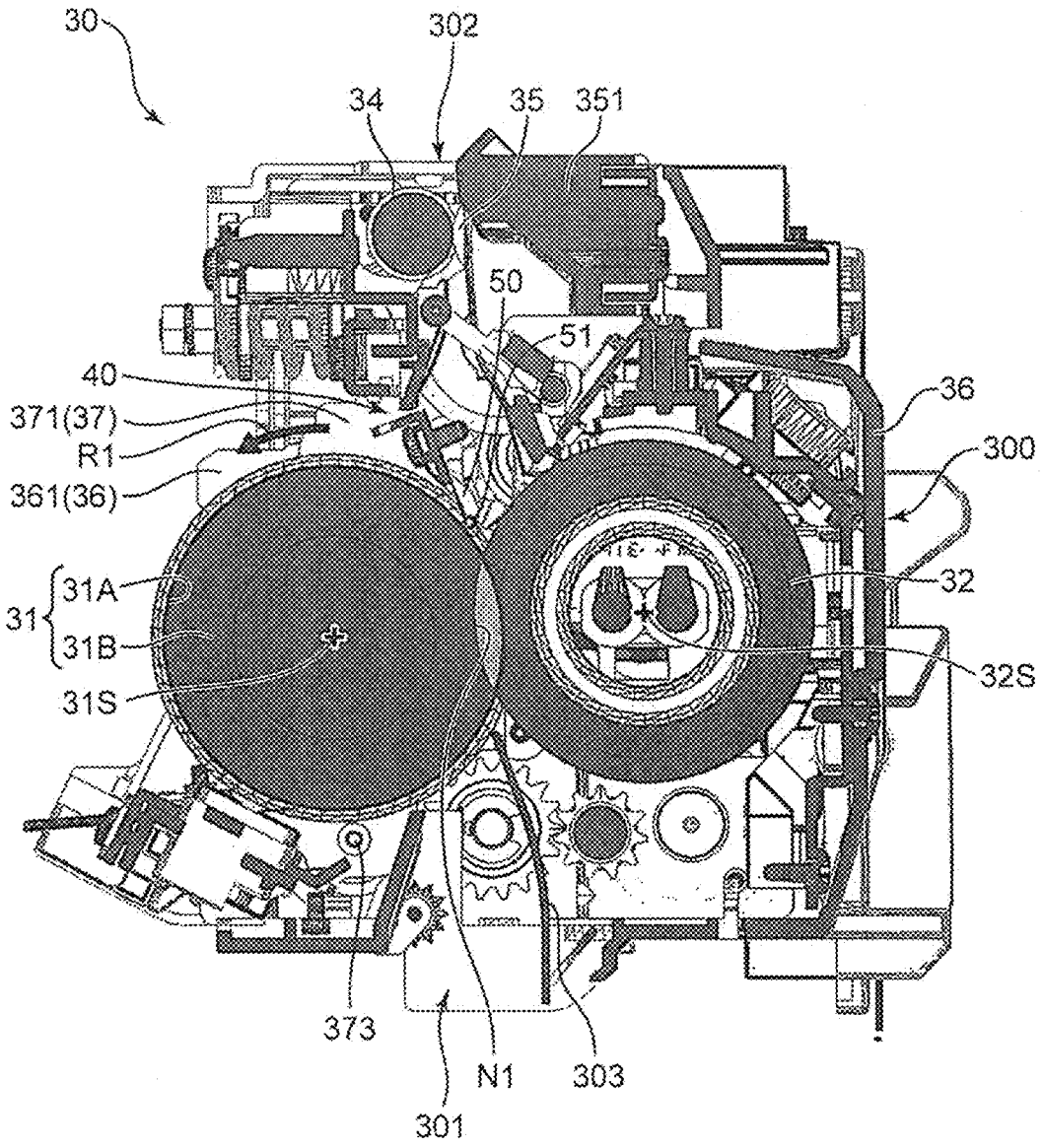
FIG. 9 is a cross sectional view showing the fusing roller in a pressure applying posture (first posture) according to one embodiment of the present disclosure.
Figure 10:
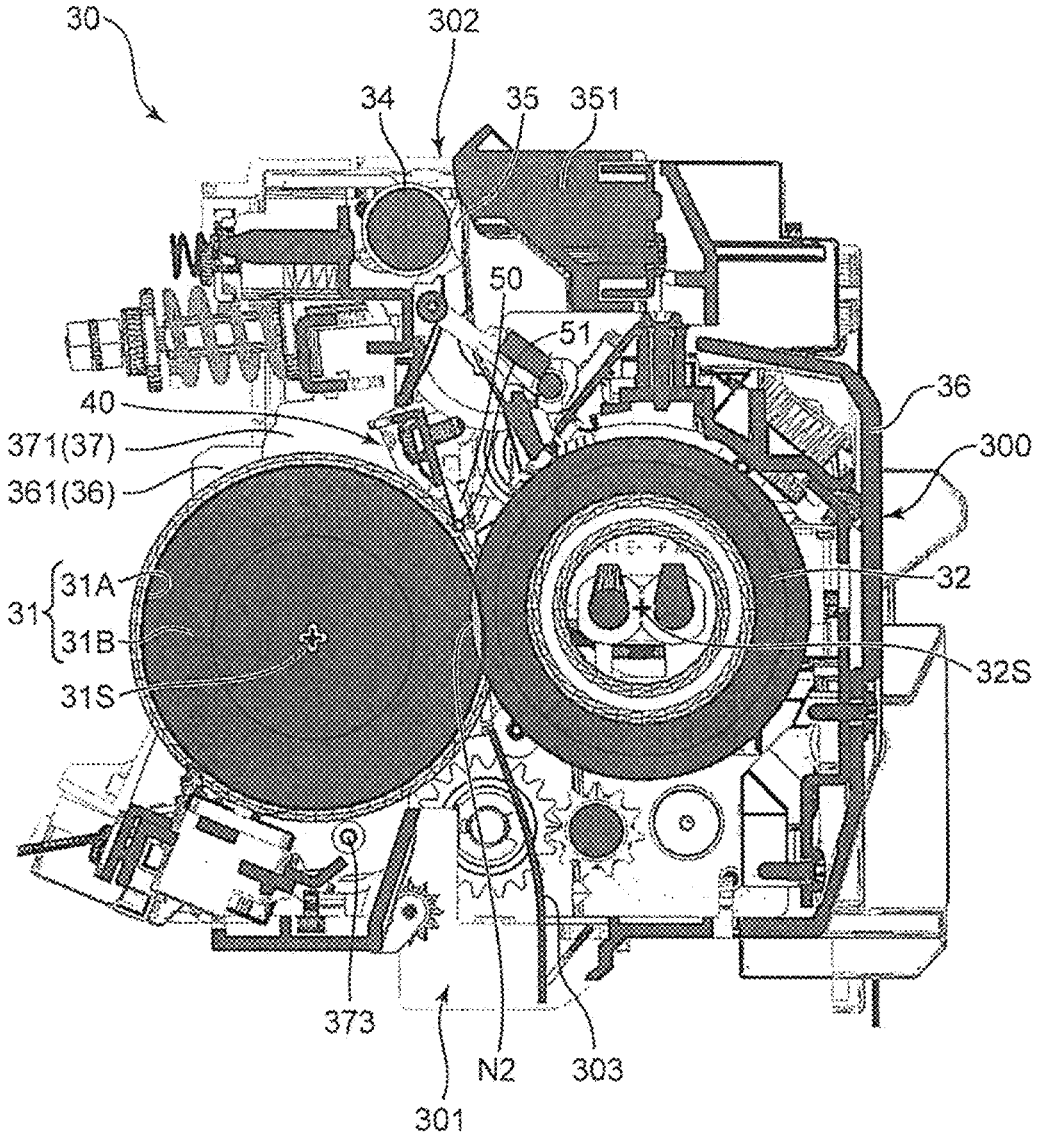
FIG. 10 is a cross sectional view showing the fusing roller in a pressure reducing posture (second posture) according to one embodiment of the present disclosure.

With reference to FIGS. 9-17, description will be made next about posture change of the fusing roller 31 and turning of the separation member 40 and the abutting member 50 accompanied by the posture change. FIGS. 9 and 10 are cross sectional views of the fusing device 30. In detail, FIG. 9 shows a state in which the fusing roller 31 is in the pressure applying posture. FIG. 10 shows a state in which the fusing roller 31 is in the pressure reducing posture.

As shown in FIG. 9, when the fusing roller 31 is in the pressure applying posture, the rotational axis 31S of the fusing roller 31 is located at a normal position relative to the rotational axis 32S of the pressure roller 32. When the rotational axis 31S of the fusing roller 31 is located at the normal position, a fusing nip part N1 is formed. The fusing nip part N1 has a nip width necessary for fusing in the image forming mode. By contrast, as shown in FIG. 10, when the fusing roller 31 is changed in posture from the pressure applying posture to the pressure reducing posturer, the rotational axis 31S shifts to a release position apart from the normal position relative to the rotational axis 32S. When the rotational axis 31S of the fusing roller 31 is located at the release position, a fusing nip part N2 is formed. The fusing nip part N2 has a minimum nip width that enables transmission of the rotational drive force of the pressure roller 32 to the fusing roller 31 in the sleep mode.

When the fusing nip part N1 is formed, the fusing roller 31 is in press contact with the pressure roller 32 by high pressure to be deformed large. A high speed image forming apparatus of which linear velocity is high requires a wide fusing nip width. In turn, the degree of deformation of the fusing roller 31 is further increased. Continuation of deformation of the fusing roller 31 may compress and deform the roller member 31B to change its original shape, thereby reducing the lifetime of the fusing roller 31. In view of this, in the present embodiment, the fusing nip part N2 shallower than the fusing nip part N1 is formed during the time other than the time in the image forming mode. This can extend the lifetime of the fusing roller 31.

Figure 14:
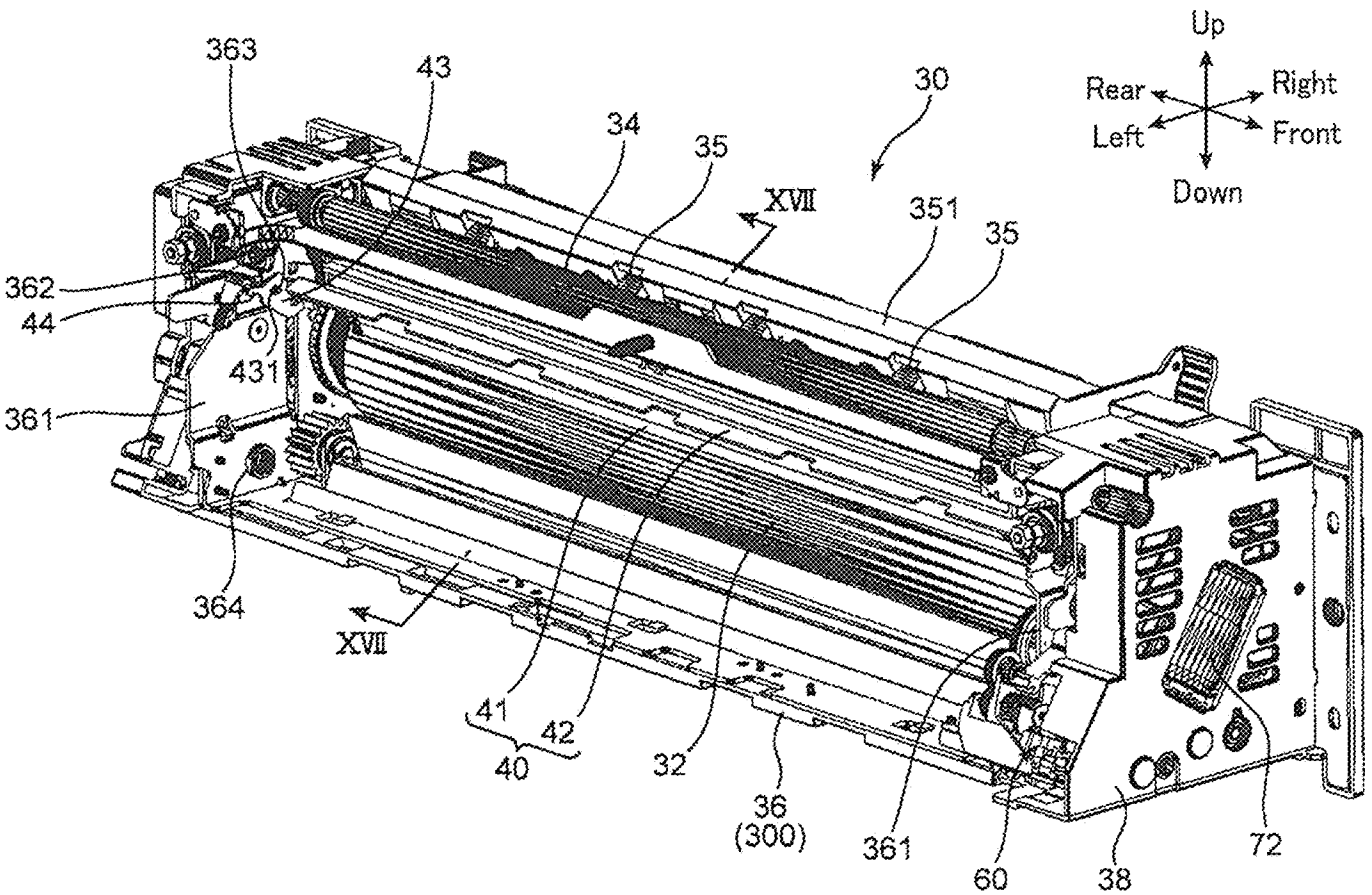
FIG. 14 is a perspective view of the fusing device from which the fusing roller is removed in one embodiment of the present disclosure.
Figure 15:
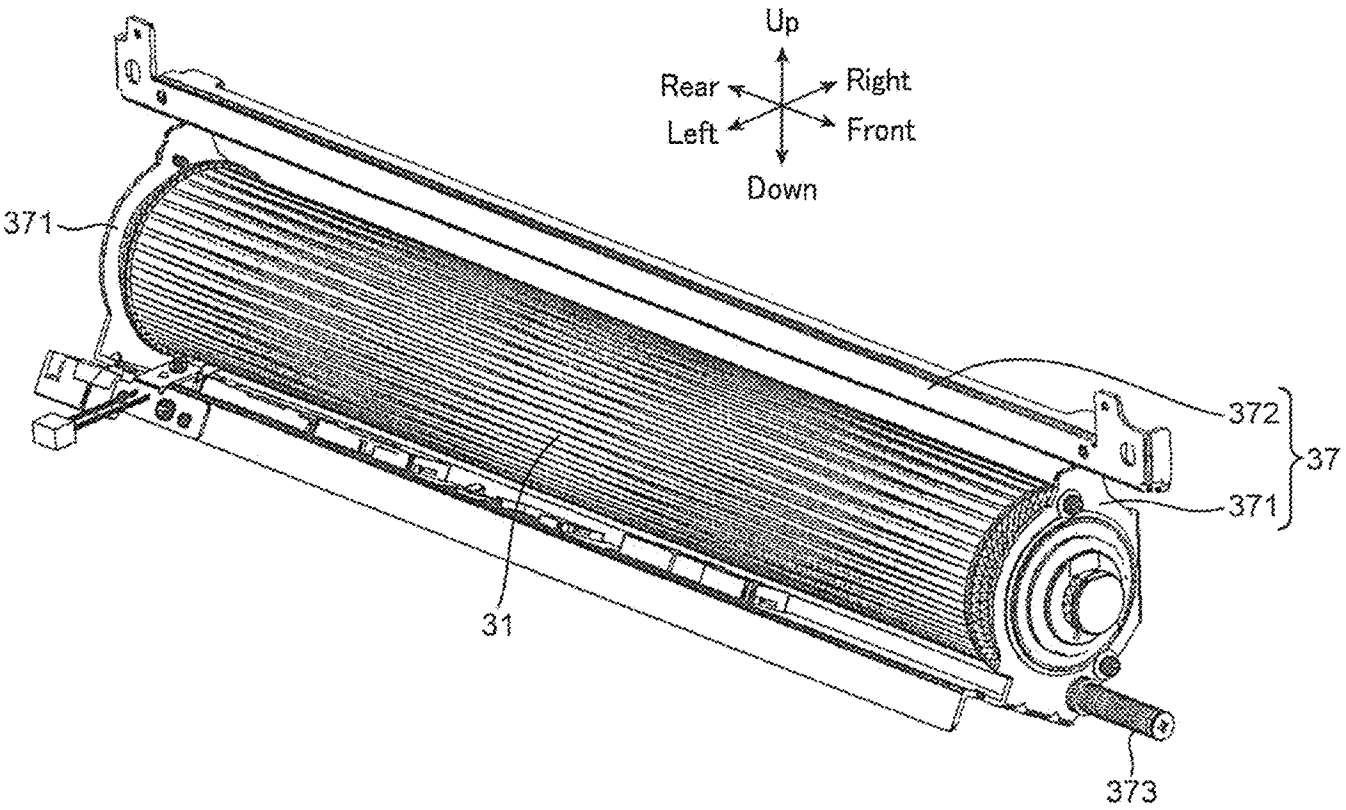
FIG. 15 is a perspective view of the fusing roller and a movable framework according to one embodiment of the present disclosure.
Figure 17:
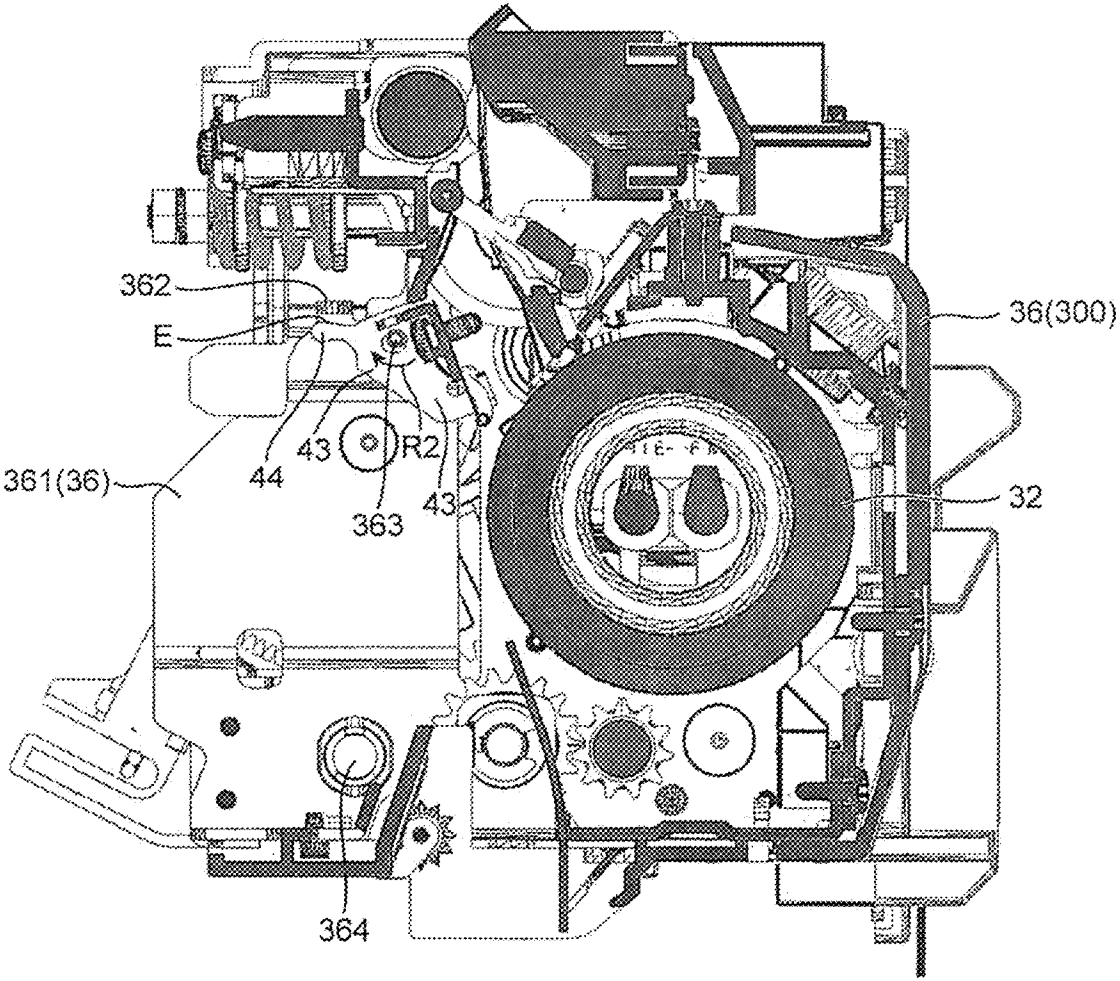
FIG. 17 is a cross sectional view taken along the line XVII-XVII in FIG. 14.

FIG. 14 is a perspective view of the fusing device 30 from which the fusing roller fixing roller 31 is removed. FIG. 15 is a perspective view of the removed fusing roller 31. FIG. 16 is a perspective view of the main part in FIG. 14. FIG. 17 is a cross sectional view taken along the line XVII-XVII in FIG. 14. The fuser housing 300 includes a fixed framework 36 and a movable framework 37 movable relative to the fixed framework 36. The fixed framework 36 holds the pressure roller 32 rotatably about the rotational axis 32S. The movable framework 37 holds the fusing roller 31 rotatably about the rotational axis 31S. Moving the movable framework 37 relative to the fixed framework 36 can achieve posture change of the fusing roller 31.

As shown in FIG. 14, the fixed framework 36 includes a pair of front and rear side plate frame members 361 that hold the pressure roller 32. The stoppers 362 and the support pins 363 protrude from the paired side plate frames 361. The space on the left side of the pressure roller 32 between the paired side plate frames 361 is a space where the fusing roller 31 is to be mounted. The movable framework 37 includes a pair of front and rear holding frame members 371 and a horizontal frame member 372 connected to the paired holding frame members 371, as shown in FIG. 15. A shaft pin 373 protruding outward in the back-and-forth directions is provided on each holding frame member 371. On the other hand, a pin receiving portion 364 to which the shaft pin 373 is to be inserted is formed in each side plate frame member 361. The movable framework 37 is mounted on the fixed framework 36 so as to be rotatable about the shaft pins 373 pivotally supported in the pin receiving portions 364. When the movable framework 37 is mounted, the side plate frame members 361 of the fixed framework 36 face the corresponding holding frame members 371 of the movable framework 37 in an adjacent manner.

A adjustment mechanism 60 including the nip pressure adjusting motor 72 and a gear mechanism is mounted on the front side plate frame member 361 of the fixed framework 36. FIGS. 14 and 4 show the state when covers 38 cover the side plate frame members 361. Accordingly, the gear mechanism is not exposed in FIGS. 14 and 4. The adjustment mechanism 60 moves the movable framework 37, that is, turns the movable framework 37 about the shaft pins 373 to move the rotational axis 31S of the fusing roller 31 in parallel to the rotational axis 32S of the pressure roller 32. Thus, the posture of the fusing roller 31 is changed between the pressure applying posture and the pressure reducing posture. It is noted that the gear mechanism has a function of transmitting drive power that the nip pressure adjusting motor 72 generates to the movable framework 37 to turn the movable framework 37 about the shaft pins 373.

When the fusing roller 31 is in the pressure applying posture, as shown in FIG. 9, the adjustment mechanism 60 sets the position of the movable framework 37 so that the rotational axis 31S is located at the normal position relative to the rotational axis 32S. When the posture of the fusing roller 31 is changed from the pressure applying posture to the pressure reducing posture shown in FIG. 10, the adjustment mechanism 60 turns (moves) the movable framework 37 about the shaft pins 373 in the direction indicated by the arrow R1 to shift the rotational axis 31S from the normal position to the release position relative to the rotational axis 32S.

Figure 11:
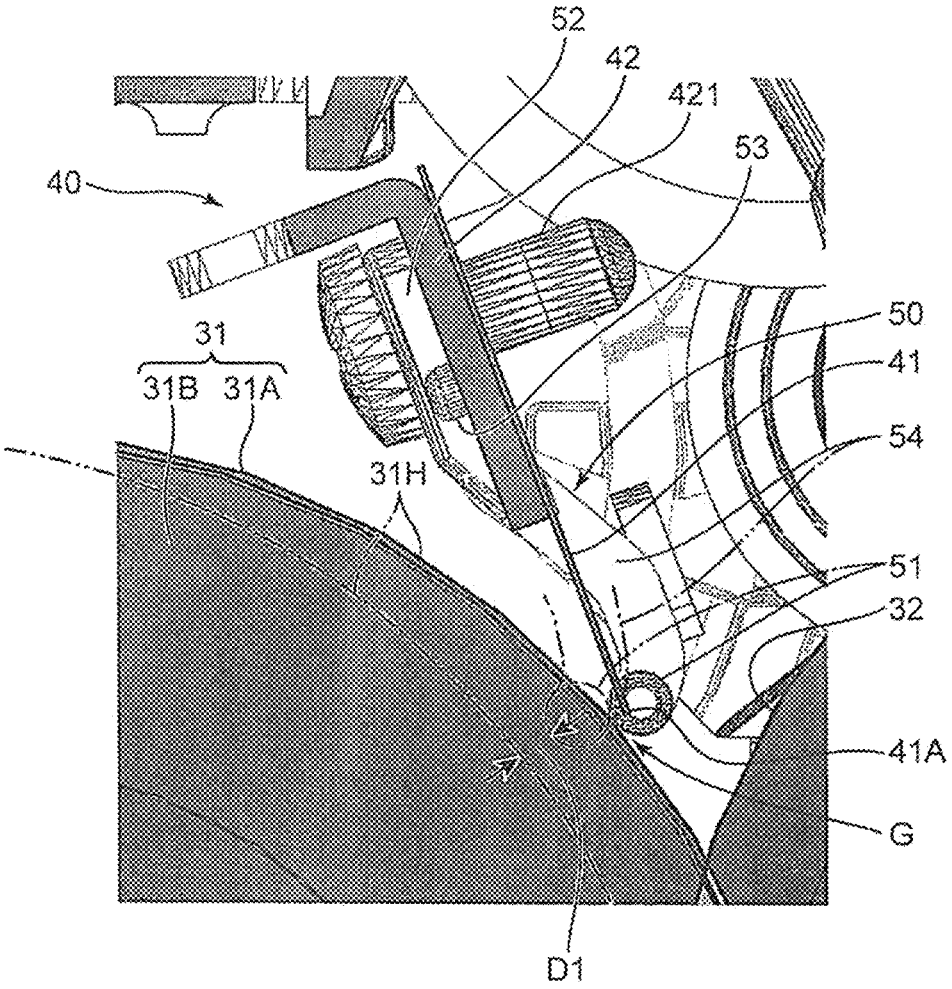
FIG. 11 is an enlarged cross sectional view of the separation member and the abutting member according to one embodiment of the present disclosure.

FIG. 11 is an enlarged cross sectional view of the separation member 40 and one abutting member 50. In FIG. 11, the solid line indicates the position of a peripheral surface 31H of the fusing roller 31 (fusing belt 31A) when the fusing roller 31 is in the pressure applying posture. By contrast, the two-dot chain line indicates the position of the peripheral surface 31H of the fusing roller 31 when the fusing roller 31 is in the pressure reducing posture. When the fusing roller 31 is in the pressure applying posture, the columnar abutting portion 51 of each abutting member 50 abuts on the peripheral surface 31H of the fusing roller 31. This forms the gap G between the tip end 41A of the separation member 40 and the peripheral surface 31H of the fusing roller 31.

By contrast, when the fusing roller 31 is in the pressure reducing posture, the abutting portion 51 of each abutting member 51 does not abut on but separates from the peripheral surface 31H of the fusing roller 31 by a distance D1. This is because the separation member 40 does not fully follow the movement of the fusing roller 31 accompanied by posture change from the pressure applying posture to the pressure reducing posture. Specifically, an isolation mechanism is provided in the fusing device 30. The isolation mechanism allows the abutting portion 51 of each abutting member 50 to abut on the peripheral surface 31H of the fusing roller 31 when the fusing roller 31 is in the pressure applying posture (first posture), while separating each of the abutting portion 51 from the peripheral surface 31H of the fusing roller 31 in the process of posture change of the fusing roller 31 from the pressure applying posture to the pressure reducing posture (second posture). When the abutting portion 51 of each abutting member 50 abuts on the peripheral surface 31H of the fusing roller 31, the tip end 41A of the separation member 40 is close to the peripheral surface 31H of the fusing roller 31.

The stoppers 362 provide at the side plate frame members 361 function as the isolation mechanism in the present embodiment. As has been described above, the protruding pieces 44 are formed on the end plates 43 of the separation member 40. The protruding pieces 44 are each located at a position where they can interfere with the corresponding stoppers 362 when the separation member 40 turns about the support pins 361. The stoppers 362 interfere with the protruding pieces 44 in the process when the adjustment mechanism 60 moves the rotational axis 31S of the fusing roller 31 from the normal position to the release position. This can separate the abutting portions 51 from the peripheral surface 31H of the fusing roller 31. This point of view will be described in detail.

Figure 12:
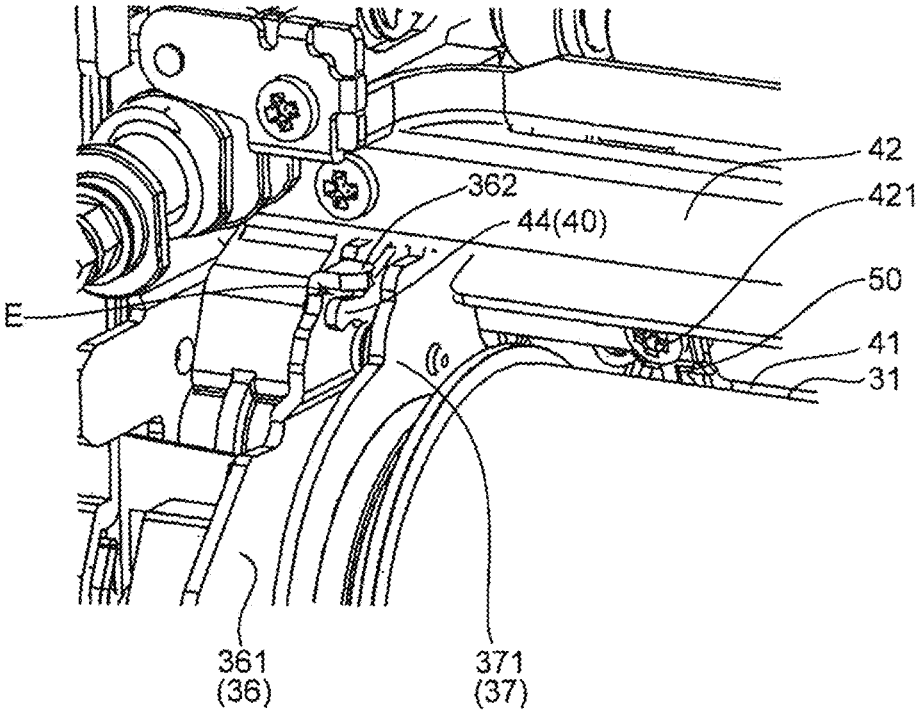
FIG. 12 is a perspective view of an isolation mechanism according to one embodiment of the present disclosure.
Figure 13:
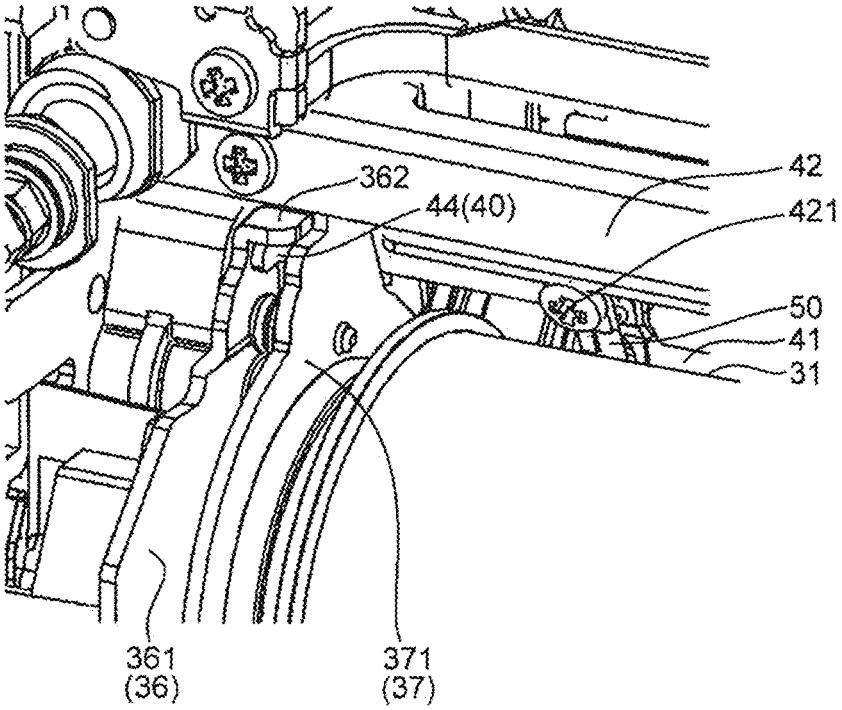
FIG. 13 is a perspective view showing a state in which the separation member is inhibited from turning in one embodiment of the present disclosure.

FIGS. 12 and 13 are perspective views showing the relationship between one stopper 362 and the corresponding protruding piece 44. FIG. 12 shows a state where the fusing roller 31 is in the pressure applying posture. In this state, a gap E is present between the stopper 362 and the protruding piece 44, and they are out of contact with each other. FIG. 13 shows a state where the fusing roller 31 is in the pressure reducing posture. In this state, the stopper 362 is in contact with the protruding piece 44 to restrict turning of the separation member 40.

As shown in FIGS. 16 and 17, the torsion coil springs 45 urge to turn the separation member 40 about the axes of the support pins 363 in the direction indicated by the arrow R2. In other words, the torsion coil springs 45 urge the separation member 40 so that its tip end 41A goes toward the peripheral surface 31H of the fusing roller 31. Thus, the abutting portions 51 of the abutting members 50 are pushed against the peripheral surface 31H of the fusing roller 31 when the fusing roller 31 is in the pressure applying posture. By contrast, when the rotational axis 31S of the fusing roller 31 moves from the normal position to the release position to move the peripheral surface 31H of the fusing roller 31 in the direction indicted by the arrow R1 (FIG. 9), the separation member 40 is turned about the axes of the support pins 363 in the direction indicated by the arrow R2 by the urging force of the torsion coil springs 45 so that the tip end 41A follows the movement of the rotational axis 31S of the fusing roller 31.

However, when the separation member 40 turns in the direction indicted by the arrow R2 to some extent, the protruding pieces 44 interfere with the stoppers 362. That is, only by the gap E between the stoppers 362 and the protruding pieces 44, the separation member 40 can turn in the direction indicated by the arrow R2 to allow the tip end 41A to follow the movement of the peripheral surface 31H of the fusing roller 31, as shown in FIGS. 16 and 17. However, upon interference of the protruding pieces 44 with the stoppers 362, the separation member 40 following the movement of the peripheral surface 31H of the fusing roller 31 is inhibited from turning. The adjustment mechanism 60 moves the movable framework 37 even after the protruding pieces 44 interfere with the stoppers 362. Accordingly, the abutting portions 51 of the abutting members 50 are separated from the peripheral surface 31H of the fusing roller 31.

As described above, in the present embodiment, the stoppers 362 inhibit the movement of the tip end 41A of the separation member 40 following the movement of the peripheral surface 31H of the fusing roller 31 (turning of the separation member 40) in the process when the rotational axis S31 of the fusing roller 31 shifts from the normal position to the release position. This can separate the abutting members 50 from the fusing roller 31. In other words, shift of the rotational axis 31S of the fusing roller 31 is linked to separation of the abutting members 50 from the peripheral surface 31H of the fusing roller 31, thereby ensuring separation of the abutting members 50 from the peripheral surface 31H of the fusing roller 31. Further, the simple configuration in which the protruding pieces 44 of the separation member 40 abut on the stoppers 362 can link the shift of the rotational axis 31S of the fusing roller 31 to the separation of the abutting members 50 from the fusing roller 31.

The image forming apparatus 1 according to the present embodiment has the above described configuration to cause the abutting members 50 not to always abut on the peripheral surface 31H of the fusing roller 31 (fusing belt 31A). That is, when the fusing roller 31 is in the pressure applying posture in the image forming mode, the abutting portions 51 of the abutting members 50 abut on the peripheral surface 31H of the fusing roller 31 to form the gap G between the tip end 41A and the peripheral surface 31H of the fusing roller 31. By contrast, in the process of posture change of the fusing roller 31 to the pressure reducing posture in the sleep mode, the abutting portions 51 separate from the peripheral surface 31H of the fusing roller 31. As has been described above, the roller drive controller 74 rotates the fusing roller 31 even in the sleep mode to uniformly heat the fusing belt 31A. While, the abutting portions 51 do not abut on the peripheral surface 31H of the fusing roller 31 in the sleep mode. Accordingly, in the sleep mode, the peripheral surface 31H of the fusing roller 31 can be prevented from being worn out. Wearing out of the fusing roller 31 may be caused by abutment of the abutting portions 51 on the peripheral surface 31H of the fusing roller 31. Accordingly, wearing out of the fusing belt 31A can be reduced as a whole at the abutting points thereof on the fusing belt 31A. Thus, the lifetime of the fusing belt 31A can be extended.

Figure 18A:
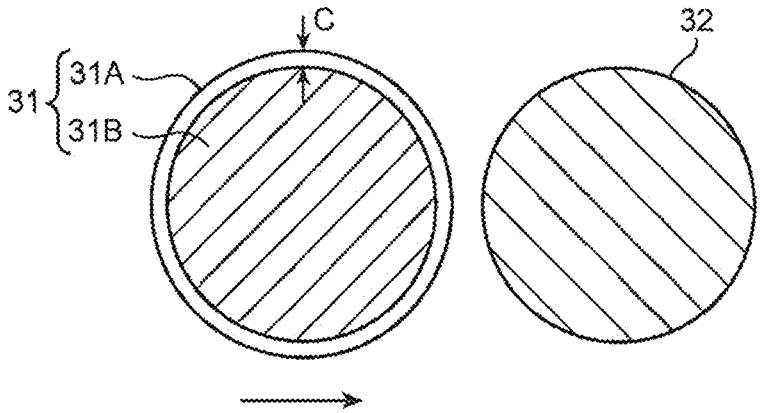
FIG. 18A is a schematic illustration for explaining press contact between the fusing roller and a pressure roller according to one embodiment of the present disclosure.
Figure 18B:
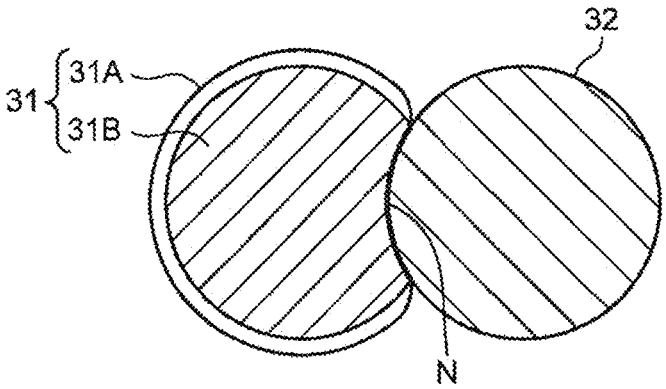
FIG. 18B is a schematic illustration for explaining press contact between the fusing roller and the pressure roller according to one embodiment of the present disclosure.

Preferable arrangement of the stoppers 362, in other words, preferable setting of the gap E will be described next. FIGS. 18A and 18B are schematic illustrations for explaining press contact between the fusing roller 31 and the pressure roller 32. The fusing roller 31 includes the elastic roller member 31B and the fusing belt 31A, as shown in FIG. 18A. The fusing belt 31A is fitted around the roller member 31B with clearance C left. The clearance C is effectively present in a non-heating state although it substantially disappears when the roller member 31B is heated to be thermally expanded.

By contrast, as shown in FIG. 18B, the pressure roller 32 presses and deforms the roller member 31B. When the fusing roller 31 is in press contact with the pressure roller 32, the peripheral surface of the fusing roller 31 is recessed in an arc shape to form the fusing nip part N with a predetermined nip width. When the fusing roller 31 is in press contact with the pressure roller 32, the presence of the clearance C results in formation of bulges each of which is a part of the fusing belt 31A swelling on the peripheral surface of the roller member 31B.

Figure 19A:
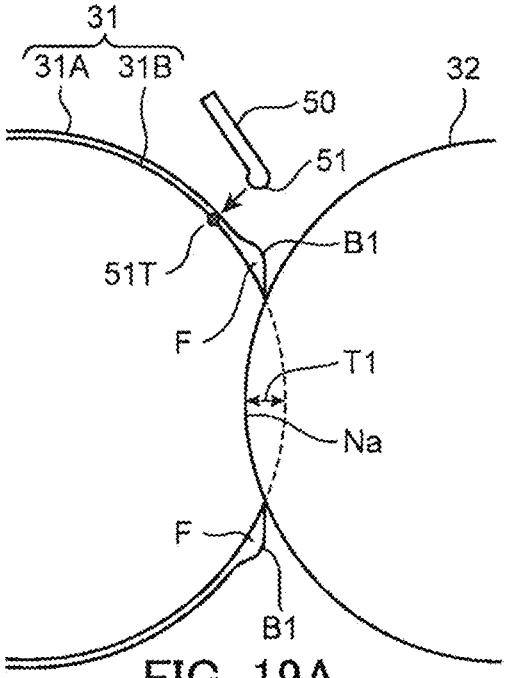
FIG. 19A is a schematic illustration for explaining the relationship between a bulge and the abutting member according to one embodiment of the present disclosure.
Figure 19B:
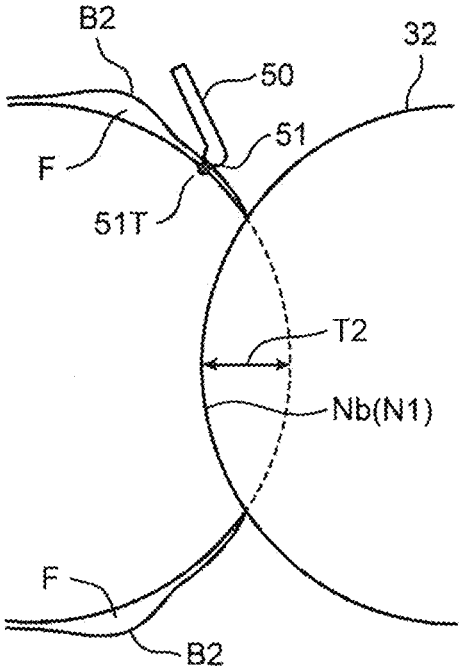
FIG. 19B is a schematic illustration for explaining the relationship between the bulge and the abutting member according to one embodiment of the present disclosure.

FIGS. 19A and 18B are schematic illustrations for explaining the relationship between the bulges and one abutting member 50. FIGS. 19A and 19B show the process of the fusing roller 31 gradually pushing the pressure roller 32.

FIG. 19A shows a state in which a fusing nip part Na with a contact depth T1 is formed. The state of the fusing roller 31 being in the pressure reducing posture transfers to the state of it pushing the pressure roller 32, thereby forming the fusing nip part Na. The contact depth T1 of the fusing nip part Na is larger than the contact depth of the fusing nip part N2 formed when the fusing roller 31 is in the pressure reducing posture and is smaller than the contact depth of the fusing nip part N1 formed when the fusing roller 31 is in the pressure applying posture.

At this time, bulges B1, each of which is a part of the fusing belt 31A swelling in a convex shape, are formed on each opposite side of the fusing nip part Na in the circumferential direction of the fusing roller 31. Each bulge B1 is formed in a manner that the clearance C is compressed at the fusing nip part Na to displace the space of the clearance C sideward of the fusing nip part Na. A hollow F in a convex shape is formed in the back of each bulge B1. Accordingly, the bulge B1 cannot be supported by the peripheral surface of the roller member 31B. The bulge B1 swells gradually largely as pushing of the fusing roller 31 progresses.

Thereafter, as pushing of the fusing roller 31 against the pressure roller 32 further progresses to increase the size of each bulge B1 to some extent, the bulge B1 moves away from the fusing nip part Na in the circumferential direction of the fusing roller 31. FIG. 19B shows a state when pushing of the fusing roller 31 progresses until a fusing nip part Nb with a contact depth T2 deeper than the contact depth T1 is formed. The contact depth T2 of the fusing nip part Nb approximates the contact depth of the fusing nip part N1 formed when the fusing roller 31 is in the pressure applying posture. The comparatively large hollow F is formed on the back of each grown bulge B2. The hollow F (bulge B2) moves away from the fusing nip part Nb.

The abutting portion 51 of each abutting member 50 abuts on the peripheral surface of the fusing roller 31 at the predetermined abutting point 51T. When the abutting portion 51 abuts on the corresponding bulge B2, which is not supported by the peripheral surface of the roller member 31B, the fusing belt 31A may be damaged. Specifically, when a force of the abutting portion 51 coming in face contact with the abutting point 51T acts on the bulge B2 in the process when the bulge B2 passes on the abutting point 51T, the abutting portion 51 may squeeze the fusing belt 31A into the hollow F. As a result, the fusing belt 31A may be damaged.

In view of the above drawback, the stoppers 362 are preferably provided so that the abutting portions 51 of the abutting members 50 abut on the peripheral surface of the fusing belt 31A at the abutting points 51T after one of the bulges B2, which is located downstream in the direction of rotation of the fusing roller 31, passes on the abutting points 51T in the process when the rotational axis 31S of the fusing roller 31 moves from the release position to the normal position. In other words, it is desirable that the gap E between the stoppers 362 and the protruding pieces 44 is set so that the abutting portions 51 come in face contact with the peripheral surface of the fusing roller 31 at the abutting points 51T after the bulges B1 are formed on the sides of the fusing nip part Na, as shown in FIG. 19A, and then, the one bulge B2 passes on the abutting points 51T as shown in FIG. 19B. This can avoid abutting of the bulge B2 swelling out as the hollow F on the abutting members 50, thereby obviating damage of the fusing belt 31A, which may be caused by interference of the abutting members 50 with the bulge B2.

As described so far, according to the fusing device 30 and the image forming apparatus 1 of the present embodiment, the abutting members 50 are separated from the peripheral surface of the fusing roller 31 in the process when the fusing roller 31 changes in posture from the pressure applying posture to the pressure reducing posture, so that the abutting members 50 do not always abut on the peripheral surface of the fusing roller 31. Accordingly, wearing out of the peripheral surface of the fusing roller 31, which may be accompanied by abutment of the abutting members 50 on the peripheral surface of the fusing roller 31, can be reduced, thereby extending the lifetime of the fusing belt 31A. This can achieve extension of the lifetime of the fusing roller 31 that forms the fusing nip part N.

Further, according to the fusing device 30 and the image forming apparatus 1 of the present embodiment, the abutting members 50 are separated from the peripheral surface of the fusing roller 31 in the process when the rotational axis 31S of the fusing roller 31 moves from the normal position to the release position. In other words, the movement of the movable framework 37 (shift of the rotational axis 31S of the fusing roller 31) is linked to the movement of the abutting members 50, which can reliably separate the abutting members 50 from the peripheral surface of the fusing roller 31.

Moreover, according to the fusing device 30 and the image forming apparatus 1 of the present embodiment, parts (protruding pieces 44) of the separation member 40 come in contact with the stoppers 362 when the rotational axis 31S of the fusing roller 31 moves from the normal position to the release position, thereby inhibiting the separation member 40 from turning. This can separate the abutting members 50 from the peripheral surface of the fusing roller 31. Thus, the isolation mechanism (mechanism for separating the abutting members 50 from the peripheral surface of the fusing roller 31) can be achieved with a simple configuration.

Still further, according to the fusing device 30 and the image forming apparatus 1 of the present embodiment, parts (protruding pieces 44) of the separation member 40 come in contact with the stoppers 362 when the rotational axis 31S of the fusing roller 31 moves from the normal position to the release position, thereby inhibiting the separation member 40 urged by the torsion coil springs 45 from turning. This can separate the abutting members 50 from the peripheral surface of the fusing roller 31. Thus, the isolation mechanism (mechanism for separating the abutting members 50 from the peripheral surface of the fusing roller 31) can be achieved with a simple configuration.

Yet further, according to the fusing device 30 and the image forming apparatus 1 of the present embodiment, the fusing roller 31 includes the elastic roller member 31B and the fusing belt 31A fitted around the roller member 31B. The pressure roller 32 presses and deforms the roller member 31B of the fusing roller 31. The abutting members 50 abut on the peripheral surface of the fusing belt 31A. With this configuration, wearing out of the peripheral surface of the fusing belt 31A, which may be accompanied by abutting of the abutting members 50 on the peripheral surface of the fusing belt 31A, can be reduced. Thus, the lifetime of the fusing belt 31A can be extended.

Furthermore, according to the fusing device 30 and the image forming apparatus 1 of the present embodiment, the abutting members 50 can be prevented from abutting on the bulge which cannot be supported by the peripheral surface of the roller member 31B. Accordingly, damage to the fusing belt 31A, which may be caused due to interference of the abutting members 50 with the bulge, can be obviated.

Still further, according to the fusing device 30 and the image forming apparatus 1 of the present embodiment, the fusing roller 31 rotates not only in the pressure applying posture but also in the pressure reducing posture. Accordingly, the heater 33 of induction heating type can be prevented from heating only the same part of the fusing roller 31, thereby achieving uniform heating of the fusing roller 31. Specifically, if the abutting members 50 abut on the peripheral surface of the fusing roller 31 even when the fusing roller 31 is in the pressure reducing posture, wearing out of the fusing roller 31 may progress. However, in the present embodiment, since the abutting members 50 are out of contact with the peripheral surface of the fusing roller 31 when the fusing roller 31 is in the pressure reducing posture, the fusing roller 31 can be prevented from being worn out.

In addition, according to the fusing device 30 and the image forming apparatus 1 of the present embodiment, the fusing roller 31 rotates even when the image forming apparatus 1 is in the sleep mode as a standby state for image formation. Accordingly, the heater 33 of induction heating type can be prevented from heating only the same part of the fusing roller 31, thereby achieving uniform heating of the fusing roller 31. Accordingly, when the mode switching section 76 switches the operating mode of the image forming apparatus 1 from the sleep mode to the image forming mode, a sheet can be allowed to immediately pass through the fusing nip part N. Specifically, if the abutting members 50 abut on the peripheral surface of the fusing roller 31 even when the fusing roller 31 is in the pressure reducing posture, wearing out of the fusing roller 31 may progress. However, in the present embodiment, since the abutting members 50 are out of contact with the peripheral surface of the fusing roller 31 when the fusing roller 31 is in the pressure reducing posture, the fusing roller 31 can be prevented from being worn out.

The embodiment of the present disclosure has been described so far. However, the present disclosure is not limited to the above embodiment and can be altered as follows, for example.

As the first roller, the fusing roller 31 of so-called single axis type, which is formed in a fashion that the fusing belt 31A covers the single roller member 31B, is exemplified in the above embodiment. The first roller may be a fusing roller of a so-called dual axis type, which is formed in a fashion that a fusing belt is wound between an elastic roller member and a heating roller arranged in close proximity to the heater 33.

The above embodiment describes an example in which the fusing roller 31 is mounted on the movable framework 37, while the pressure roller 32 is mounted on the fixed framework 36. Rather, the pressure roller 32 may be mounted on the movable framework 37, and the fusing roller 31 may be mounted on the fixed framework 36.

In the above embodiment, the protruding pieces 44 of the separation member 40 urged by the torsion coil springs 45 abut on the stoppers 362 as the isolation mechanism and stop. However, this is merely one example, and the isolation mechanism may be a mechanism in which a claw provided at the separation member 40 fits into a groove formed in the fixed framework 36. Alternatively, a retractable member that moves in association with movement of the movable flame 37 may inhibit the separation member 40 from turning.

What is claimed is:

1. An image forming apparatus comprising:

an image forming section configured to transfer a toner image to a sheet;

a fusing device configured to fuse the toner image to the sheet, the fusing device including:

a first roller configured to rotate about its axis;

a second roller configured to rotate about its axis and to form a fusing nip part together with the first roller;

an adjustment mechanism configured to change posture of the first roller or the second roller between first posture and second posture to adjust a nip pressure of the fusing nip part, the adjusting mechanism setting the first or second roller in the first posture to allow the first or second roller to be in press contact with the second or first roller by a first pressure, and setting the first or second roller in the second posture to allow the first or second roller to be in press contact with the second or first roller by a second pressure which is reduced from the first pressure;

a separation member arranged downstream of the fusing nip part in a direction of rotation of the first roller and including a plate-shaped member extending in an axial direction of the first roller;

a turning mechanism configured to turn the separation member about an axis parallel to the axial direction of the first roller, the turning mechanism turning the separation member so that a tip end of the plate-shaped member approaches a peripheral surface of the first roller when the posture of the first or second roller is changed from the second posture to the first posture;

an abutting member mounted on each opposite end of the plate-shaped member of the separation member and configured to abut, when the first or second roller is in the first posture, on the peripheral surface of the first roller in a vicinity of each opposite end of the first roller to form a gap between the tip end of the plate-shaped member and the peripheral surface of the first roller, the abutting member being separated from the peripheral surface of the first roller when the first or second roller is in the second posture;

an isolation mechanism configured to allow the abutting member to abut on the peripheral surface of the first roller when the first or second roller is in the first posture and to separate the abutting member from the peripheral surface of the first roller in a process when the posture of the first or second roller is changed from the first posture to the second posture so as to create a state in which the abutting member is separated from the peripheral surface of the first roller; and a heater of induction heating type configured to heat the first roller, a drive section configured to drive the first roller or the second roller;

a mode switching section configured to switch an operating mode of the image forming apparatus between a first mode and a second mode, the first mode being a mode in which image formation is performed on a sheet to cause the sheet to pass through the fusing nip part, and the second mode being a standby state for image formation to cause no sheet to pass through the fusing nip part; and a controller configured to control the adjustment mechanism so that the first or second roller is in the first posture in the first mode and so that the first or second roller is in the second posture in the second mode and to control the drive section so that the first and second rollers rotate in the first mode and so that the first and second rollers rotate in the second mode.

2. The image forming apparatus according to claim 1, wherein the fusing device further includes:

a fixed framework configured to hold the second roller rotatably about its axis; and a movable framework configured to hold the first roller rotatably about its axis and to move relative to the fixed framework, wherein the first roller includes a first rotational axis, the second roller includes a second rotational axis, the adjustment mechanism:

moves the movable framework to change the posture of the first roller between the first posture and the second posture;

sets, when the first roller is in the first posture, a position of the movable framework so that the first rotational axis is located at a usual position relative to the second rotational axis; and moves, when the posture of the first roller is changed from the first posture to the second posture, the movable framework so that the first rotational axis shifts to a release position separated from the normal position relative to the second rotational axis, and the isolation mechanism separates the abutting member from the peripheral surface of the first roller in a process when the first rotational axis moves from the normal position to the release position.

3. The image forming apparatus according to claim 2, wherein the turning mechanism includes a support portion provided at the fixed framework, the support portion supporting the separation member rotatably about its axis which is parallel to the axial direction of the first roller, when the first rotational axis moves from the normal position to the release position, the separation member turns about the supporting portion so that the tip end of the plate-shaped member follows movement of the peripheral surface of the first roller accompanied by shift of the first rotational axis, the isolation mechanism includes a stopper provided on the fixed framework, and when the separation member turns about the supporting portion, a part of the separation member abuts on the stopper to inhibit the tip end of the plate-shaped member from following the movement of the peripheral surface of the first roller in a process when the first rotational axis shifts.

4. The image forming apparatus according to claim 2, wherein the turning mechanism includes:

a supporting portion provided on the fixed framework and configured to support the separation member rotatably about its axis which is parallel to the axial direction of the first roller; and an urging member configured to urge the separation member to turn the separation member about the supporting portion in a direction in which the tip end of the plate-shaped member goes toward the peripheral surface of the first roller, when the first rotational axis moves from the normal position to the release position, the urging member urges to turn the separation member about the supporting portion so that the tip end of the plate-shaped member follows movement of the peripheral surface of the first roller accompanied by shift of the first rotational axis, the isolation mechanism includes a stopper provided on the fixed framework, and when the separation member turns about the supporting portion, a part of the separation member abuts on the stopper to inhibit the tip end of the plate-shaped member from following the movement of the peripheral surface of the first roller in a process when the first rotational axis shifts.

5. The image forming apparatus according to claim 3, wherein the first roller is a fusing roller including an elastic roller member and a fusing belt fitted around the roller member with clearance left, the second roller is a pressure roller configured to press and deform the roller member, the abutting member abuts on a peripheral surface of the fusing belt, in a process when the fusing roller gradually and compressively pushes the pressure roller when the first rotational axis moves from the release position to the normal position, a bulge, which is a part of the fusing belt swelling on the peripheral surface of the roller member, is formed in a vicinity of the fusing nip part, and the bulge moves away from the fusing nip part, and the stopper is arranged so that the abutting member abuts on the peripheral surface of the fusing belt after the bulge passes on a position where the abutting member is to abut on the peripheral surface of the fusing belt in the process when the first rotational axis moves from the release position to the normal position.

6. The image forming apparatus according to claim 1, wherein the first roller is a fusing roller including an elastic roller member and a fusing belt fitted around the roller member, the second roller is a pressure roller configured to press and deform the roller member, and the abutting member abuts on a peripheral surface of the fusing belt.

* * * * *